US007956672B2

(12) United States Patent
Aota

(10) Patent No.: US 7,956,672 B2
(45) Date of Patent: Jun. 7, 2011

(54) REFERENCE VOLTAGE GENERATING CIRCUIT

(75) Inventor: Hideyuki Aota, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 685 days.

(21) Appl. No.: 11/090,867

(22) Filed: Mar. 28, 2005

(65) Prior Publication Data

US 2005/0242870 A1 Nov. 3, 2005

(30) Foreign Application Priority Data

Mar. 30, 2004 (JP) ..... 2004-100007

(51) Int. Cl.
*G05F 1/10* (2006.01)

(52) U.S. Cl. ..... 327/530; 327/538; 257/537

(58) Field of Classification Search ..... 327/538–543, 327/512, 513, 530; 323/312–317; 257/506, 257/516, 536–538; 29/17.1, 610.1
See application file for complete search history.

(56) References Cited

U.S. PATENT DOCUMENTS

| | | | | |
|---|---|---|---|---|
| 4,460,494 | A * | 7/1984 | Abe et al. | 252/512 |
| 4,507,852 | A * | 4/1985 | Karulkar | 438/625 |
| 4,672,740 | A * | 6/1987 | Shirai et al. | 438/655 |
| 4,947,020 | A * | 8/1990 | Imamura et al. | 219/121.65 |
| 5,300,813 | A * | 4/1994 | Joshi et al. | 257/752 |
| 5,312,775 | A * | 5/1994 | Fujii et al. | 438/625 |
| 5,408,130 | A * | 4/1995 | Woo et al. | 257/758 |
| 5,874,358 | A * | 2/1999 | Myers et al. | 438/640 |
| 6,111,397 | A * | 8/2000 | Leung | 323/315 |
| 6,265,777 | B1 * | 7/2001 | Kobayashi | 257/757 |
| 6,274,452 | B1 * | 8/2001 | Miura et al. | 438/384 |
| 6,667,537 | B1 * | 12/2003 | Koike et al. | 257/536 |
| 6,809,034 | B2 * | 10/2004 | Ito et al. | 438/706 |
| 7,312,515 | B2 * | 12/2007 | Yamashita et al. | 257/537 |
| 7,718,502 | B2 * | 5/2010 | Yamashita et al. | 438/382 |
| 2003/0214336 | A1 * | 11/2003 | Watanabe | 327/200 |
| 2004/0188770 | A1 * | 9/2004 | Asano et al. | 257/379 |
| 2004/0262709 | A1 * | 12/2004 | Yamashita et al. | 257/516 |

FOREIGN PATENT DOCUMENTS

JP 2001-284464 10/2001

* cited by examiner

*Primary Examiner* — Thomas J Hiltunen
(74) *Attorney, Agent, or Firm* — Dickstein Shapiro LLP

(57) ABSTRACT

A reference voltage generating circuit includes a resistance dividing circuit formed with resistors connected in series. This circuit includes: a first power supply circuit that is formed with field effect transistors, and outputs voltage having a negative temperature coefficient with respect to a change in environmental temperature; a source follower circuit that includes a first field effect transistor connected to the gate of the first power supply circuit, and the resistance dividing circuit formed with the resistors that are connected in series between the drain and ground of the first field effect transistor and between the source of the first field effect transistor and power supply voltage, and adjusts the deviation in the negative temperature coefficient of the voltage that is output from the first power supply circuit; and a second power supply circuit that is connected to the source follower circuit, is formed with field effect transistors, generates voltage having a positive temperature coefficient with respect to a change in environmental temperature, and outputs voltage having the deviation in temperature coefficient compensated for.

10 Claims, 14 Drawing Sheets

REFERENCE VOLTAGE GENERATING CIRCUIT

BACKGROUND OF THE INVENTION

1. Field of the Invention

The present invention relates to a technique of stabilizing the output of a reference voltage generating circuit that is used for battery-driven portable telephone devices.

2. Description of the Related Art

The threshold value of a field effect transistor (hereinafter referred to as FET) varies with environmental temperature. To counter this problem, a reference voltage generating circuit that can output a stable reference voltage Vref in spite of changes in environmental temperature has been developed. In this reference voltage generating circuit, field effect transistors having gates of different conductivity types are combined to provide a circuit that outputs a first voltage (Vpn) having a negative temperature coefficient with respect to a change in environmental temperature, and field effect transistors having gates of the same conductivity type and different doped-impurity concentrations are combined to provide a circuit that outputs a second voltage (Vnn) having a positive temperature coefficient. The temperature coefficient of the first voltage is adjusted, and the adjusted first voltage and the second voltage are added so as to output the stable reference voltage Vref. Such a reference voltage generating circuit that utilizes the gate work function difference is disclosed in Japanese Laid-Open Patent Application No. 2001-284464, for example. Hereinafter, the process of flattening the deviation in the temperature coefficients will be referred to as the temperature characteristics compensation.

FIG. 15A illustrates the structure of a reference voltage generating circuit 110 that utilizes the gate work function difference. This circuit includes p-channel FETs 101 through 105, and resistors 106 and 107. The FETs 101, 102, 104, and 105 have the same substrate-doping and channel-doping impurity concentrations, and are formed in the n-well of a p-type substrate. The substrate potential of each transistor is set at the same value as the source potential.

The FET 101 has an n-type gate that is doped with a high-concentration impurity (hereinafter referred to simply as the high-concentration n-type gate), and the FET 102 has a p-type gate that is doped with a high-concentration impurity (hereinafter referred to simply as the high-concentration p-type gate). The FET 101 and the FET 102 are designed to have the ratio (S=W/L) of the channel width W to the channel length L at the same value.

The FET 104 has a high-concentration p-type gate, and the FET 105 has a p-type gate that is doped with a low-concentration impurity (hereinafter referred to simply as the low-concentration p-type gate). The FETs 104 and 105 are designed to have the same ratio (S=W/L) of the channel width W to the channel length L.

Potential is supplied to the gate of the FET 101 from a source follower circuit that includes a resistance dividing circuit formed with the FET 103 having a high-concentration p-type gate and the two resistors 106 and 107 that are connected in series. The gate of the FET 102 and the gate of the FET 103 are connected to each other. The source and the gate of the FET 103 are connected to each other. The gate of the FET 101 is connected to the connection point between the source of the FET 103 and the resistor 106 (the point P10 representing potential V10 in FIG. 15A). The drain of the FET 103 is connected to the gate of the FET 105.

The FET 102 has the source and the gate connected to each other, and functions as a constant current source to supply constant current to the FET 101, to which the FET 102 is series-connected. In this structure, the potential between the source and the gate of the FET 101 that is calculated by subtracting the potential V10 from power supply voltage Vcc is Vpn (=Vcc−V10). Meanwhile, potential V11 is represented as (the resistance value of the resistor 107/the resistance value of the resistor 106)×Vpn.

The FET 104 has the source and the gate connected to each other, and functions as a constant current source to supply constant current to the FET 105, to which the FET 104 is series-connected. With the potential between the source and the gate of the FET 105 being Vnn, the source potential V12 of the FET 105 is represented as V11+Vnn=(the resistance value of the resistor 107/the resistance value of the resistor 106)×Vpn+Vnn (=Vref).

The FET 101 and the FET 102 that are connected in series form a first power supply circuit that exhibits a negative temperature coefficient with respect to a variation in environmental temperature. Meanwhile, the FET 104 and the FET 105 that are connected in series form a second power supply circuit that exhibits a positive temperature coefficient with respect to a variation in environmental temperature. The resistance values of the resistor 106 and the resistor 107, which form the resistance dividing circuit in the source follower circuit, are adjusted by a trimming technique, for example. By doing so, the deviation in the negative temperature coefficient is adjusted, and the positive and negative temperature coefficients are cancelled. In this manner, a circuit that compensates the temperature characteristics and outputs a constant reference voltage Vref in spite of variations in environmental temperature is formed.

The deviations in the temperature coefficients of the respective circuits can be adjusted by changing the impurity concentrations of the high-concentration n-type gate of the FET 101, the high-concentration p-type gates of the FETs 102, 103, and 104, and the low-concentration p-type gate of the FET 105, as well as the resistance values of the resistors 106 and 107.

FIG. 15B illustrates the structure of a reference voltage generating circuit 120 that has a different structure from the reference voltage generating circuit 110. This reference voltage generating circuit 120 includes p-channel FETs 121 through 123, a FET 126, a FET 127, and resistors 124 and 125. The FETs 121, 122, 126, and 127 have the same substrate-doping and channel-doping impurity concentrations, and are formed in the n-well of a p-type substrate. The substrate potential of each transistor is set at the same value as the source potential.

The FET 121 has a high-concentration n-type gate, and the FET 122 has a high-concentration p-type gate. The FET 121 and the FET 122 are designed to have the ratio (S=W/L) of the channel width W to the channel length L at the same value.

The FET 126 has a high-concentration p-type gate, and the FET 127 has a low-concentration p-type gate. The FETs 126 and 127 are designed to have the same ratio (S=W/L) of the channel width W to the channel length L.

Potential is supplied to the gate of the FET 121 from a source follower circuit that includes a resistance dividing circuit formed with the FET 123 having a high-concentration p-type gate and the two resistors 124 and 125 that are connected in series. The gate of the FET 122 and the gate of the FET 123 are connected to each other. The source and the gate of the FET 123 are connected to each other. The gate of the FET 121 is connected to the connection point between the source of the FET 123 and the resistor 125 (the point P13 representing potential V13 in FIG. 15B). The contact point P15 between the resistors 124 and 125 is connected to the gate of the FET 126.

The FET 122 has the source and the gate connected to each other, and functions as a constant current source to supply constant current to the FET 121, to which the FET 122 is series-connected. In this structure, the potential between the source and the gate of the FET 121 that is calculated by subtracting the potential V13 from power supply voltage Vcc is Vpn (=Vcc−V13). Meanwhile, potential V14 is represented as Vcc−[(the resistance value of the resistor 124)×(the resistance value of the resistor 124+the resistance value of the resistor 125)×Vpn].

The FET 126 has the source and the gate connected to each other, and functions as a constant current source to supply constant current to the FET 127, to which the FET 126 is series-connected. With the potential between the source and the gate of the FET 127 being Vnn, the source potential V15 of the FET 127 is represented as Vcc−V14+Vnn=(the resistance value of the resistor 124/(the resistance value of the resistor 124+the resistance value of the resistor 125))×Vpn+Vnn (=Vref).

The FET 121 and the FET 122 that are connected in series form a first power supply circuit that exhibits a negative temperature coefficient with respect to a variation in environmental temperature. Meanwhile, the FET 126 and the FET 127 that are connected in series form a second power supply circuit that exhibits a positive temperature coefficient with respect to a variation in environmental temperature. The resistance values of the resistor 124 and the resistor 125, which form the resistance dividing circuit in the source follower circuit, are adjusted by a trimming technique, for example. By doing so, the deviation in the negative temperature coefficient is adjusted, and a circuit that compensates the temperature characteristics and outputs a constant reference voltage Vref in spite of variations in environmental temperature is formed. The deviations in the temperature coefficients of the respective circuits can be adjusted by changing the impurity concentrations of the high-concentration p-type gate of the FET 122 and the low-concentration n-type gate of the FET 127, as well as the resistance values of the resistors 124 and 125.

As is apparent from the comparison between the reference voltage generating circuit 110 (hereinafter referred to simply as the circuit 110) and the reference voltage generating circuit 120 (hereinafter referred to simply as the circuit 120), there are no characteristic differences between the first-stage circuit that is formed with the FET 101 and the FET 102 of the 110 and the first-stage circuit that is formed with the FET 121 and the FET 122 of the circuit 120, and between the second-stage circuit that is formed with the FET 103 and the resistors 106 and 107 of the circuit 110 and the second-stage circuit that is formed with the FET 123 and the resistors 124 and 125. The potential difference between the two ends of the resistor 106 of the circuit 110, and the potential difference between the two ends of the resistors 124 and 125 of the circuit 120 are both Vpn. Accordingly, the voltage Vds1 between the drain and the source of each of the FET 101 of the circuit 110 and the FET 121 of the circuit 120 is determined by Vpn+Vgs (the voltage between the source and the gate of each of the FET 103 of the circuit 110 and the FET 123 of the circuit 120).

Here, the voltage Vds2 between the drain and the source of each of the FET 102 of the circuit 110 and the FET 122 of the circuit 120 is determined by the equation: Vds2=Vcc−Vds1. As is apparent from this equation, only the voltage Vds2 between the drain and the source of each of the FET 102 of the circuit 110 and the FET 122 of the circuit 120 is affected by a variation in Vcc.

FIG. 17 shows the Vg-Id characteristics of the FET 101 and the FET 102 of the circuit 110 when the power supply voltage Vcc varied. As the power supply voltage Vcc becomes higher, the Vg-Id characteristics of the FET 102 vary, and Vpn increases by ΔVpn. Although not shown, the Vg-Id characteristics of the FET 121 and the FET 122 of the circuit 120 are the same as the Vg-Id characteristics of the FET 101 and the FET 102 of the circuit 110 in that as the power supply voltage Vcc becomes higher, Vpn increases by ΔVpn.

As for the third-stage circuit that is formed with the FET 104 and the FET 105 of the circuit 110 and the third-stage circuit that is formed with the FET 126 and the FET 127 of the circuit 120, the FET 104 and the FET 126 serve as constant current sources to generate Vnn between the source-gate voltage of each of the FET 104 and the FET 126 and the source-gate voltage of each of the FET 105 and the FET 127. While the source-gate voltage Vgs of the FET 104 is 0, the source-gate voltage Vgs of the FET 126 is determined by (the resistance value of the resistor 124)/(the resistance value of the resistor 124+the resistance value of the resistor 125)×Vpn.

Accordingly, Vpn varies in either of the circuits 110 and 120. However, only in the circuit 120 illustrated in FIG. 15B, the Vpn variation affects the constant current source of the third-stage circuit. As the source-gate voltage Vgs of the constant current source varies, the operating point moves, resulting in a variation in Vnn. In short, when the power supply voltage Vcc varies, only Vpn varies in the circuit 110, but both Vpn and Vnn vary in the circuit 120. From this fact, the reference voltage generating circuit 110 illustrated in FIG. 15A is the more stable circuit.

FIGS. 16A and 16B show Vref variations with respect to variations in the power supply voltage Vcc (hereinafter referred to as the input stability) and Vref variations with respect to temperature variations (hereinafter referred to as the temperature characteristics) in each of the circuits 110 and 120. The circuits 110 and 120 have the same ideal values for the temperature characteristics. The input stability indicates the stability of the value of the reference voltage Vref to be output with respect to a variation in the value of the power supply voltage Vcc. The more stable the reference voltage Vref is, the closer the value is to the ideal value. As for the temperature characteristics, the value becomes closer to the ideal value as the deviations of the temperature coefficient become more flat. In FIGS. 16A and 16B, the input stability and the temperature characteristics of each of the circuits 110 and 120 having polycrystalline silicon resistors are shown by ♦, and the ideal values are shown by ▲.

In the case with the ideal resistors indicated by ▲, the input stability of the circuit 110 is higher than the input stability of the circuit 120, and the temperature characteristics are the same between the circuits 110 and 120. In the case with resistors made of polycrystalline silicon, however, the input stability and the temperature characteristics of the circuit 110 are much poorer than the ideal values, as indicated by ♦.

The reasons for this can be considered as follows. In the case of a resistor made of polycrystalline silicon, the carrier density in the polycrystalline silicon is affected by the potential difference between conductors such as metal wires in contact with a surface of the polycrystalline silicon and a substrate insulator or a well in contact with the other surface of the polycrystalline silicon. As a result, the resistance value varies.

In the case where the potential of the resistor made of polycrystalline silicon and the potential of the conductor connected to the resistors are both 0 v, for example, the resistor made of polycrystalline silicon exhibits a desired value, because there is not a potential difference between the resistor and the conductor.

If the potential of the polycrystalline silicon resistor is increased from 0 v to 1 v while the potential of the conductor remains 0 v, the potential difference (ΔV) between the polycrystalline silicon resistor and the conductor becomes −1 v, which is a negative value. If the polycrystalline silicon resistor is an n-type resistor, a depletion layer is formed in the resistor, and the resistance value becomes greater.

Under the bias condition that the potential difference (ΔV) is a positive value, an accumulation layer is formed in the resistor. As a result the resistance value of the polycrystalline silicon resistor becomes smaller.

FIG. 18A shows the potential difference (ΔV) between the resistances 106 and 107 and the n-well of the circuit 110. FIG. 18B shows the potential difference (ΔV) between the resistances 124 and 125 and the n-well of the circuit. The potential difference (ΔV) with the n-well that is a conductor in contact with any of the resistors 106, 124, and 125 is not affected by the Vcc variation. However, the potential difference (ΔV) between the resistor 107 and the n-well varies with the Vcc variation. In short, the resistance value of the resistor 107 varies as the power supply voltage Vcc varies. As a result, the potential V11 that is represented as (the resistance value of the resistor 107)/(the resistance value of the resistor 106)×Vpn varies, and so does the value of the reference voltage Vref. In the case with resistors made of polycrystalline silicon, the circuit 110 exhibits poorer values than the circuit 120 with respect to the ideal values, as shown in FIG. 16A.

Any depletion layer or any accumulation layer caused in the resistors has dependency on temperature. The temperature dependency becomes greater, as the potential difference (ΔV) becomes greater. Since the resistor 107 exhibits the greatest potential difference (ΔV) among the resistors 106, 107, 124, and 125, the circuit 110 is farther away from the ideal values than the circuit 120 is from the ideal values, as shown in FIG. 16B.

SUMMARY OF THE INVENTION

A general object of the present invention is to provide a reference voltage generating circuit in which the above disadvantages are eliminated.

A more specific object of the present invention is to provide a reference voltage generating circuit with high efficiency that exhibits input stability and temperature characteristics that are very close to ideal values.

The above objects of the present invention are achieved by a reference voltage generating circuit that includes a resistance dividing circuit that has resistors connected in series. In this reference voltage circuit, the resistors are formed with metal thin film.

As the metal thin film is used for the resistors in this circuit, a depletion layer or an accumulation layer is not easily formed, compared with the case of a resistor made of polycrystalline silicon. Also, the stability of the reference voltage with respect to a variation in environmental temperature, and the stability of the reference voltage to be output with respect to a change in the potential of the circuit driving voltage can be increased.

This reference voltage generating circuit further includes:

a first power supply circuit that is formed with field effect transistors having gates of different conductivity types, and outputs voltage having a negative temperature coefficient with respect to a variation in environmental temperature;

a source follower circuit that includes: a first field effect transistor that is connected to the gate of the first power supply circuit; and the resistance dividing circuit formed with the resistors that are connected in series between the drain and ground of the first field effect transistor and between the source of the first field effect transistor and power supply voltage Vcc, and adjusts the deviation in the negative temperature coefficient of the voltage that is output from the first power supply circuit; and a second power supply circuit that is connected to the source follower circuit, is formed with field effect transistors having the same conductivity type and gates with different impurity concentrations, generates voltage having a positive temperature coefficient with respect to a variation in environmental temperature, adds the outputs of the source follower circuit, and outputs voltage having a compensated temperature coefficient deviation.

In this reference voltage generating circuit, circuits that exhibit positive and negative temperature coefficients with respect to a variation in environmental temperature are combined to cancel the deviations of the temperature coefficients or compensate the temperature characteristics. Especially, the source follower circuit includes a field effect transistor that is connected to the gate of the first power supply circuit, and the resistance dividing circuit formed with the two resistors that are connected in series between the drain and ground of the field effect transistor and between the source of the field effect transistor and the power supply voltage Vcc. The source follower circuit adjusts the deviation of the negative temperature coefficient of the voltage that is output from the first power supply circuit. As the resistors of this reference voltage generating circuit are made of metal thin film, a depletion layer or an accumulation layer is not easily formed, compared with the case of a resistor made of polycrystalline silicon. Also, the stability of the reference voltage with respect to a variation in environmental temperature, and the stability of the reference voltage to be output with respect to a change in the potential of the circuit driving voltage can be dramatically increased.

In this reference voltage generating circuit, the metal thin film is made of CrSi.

With the resistors formed with the metal thin film made of CrSi, a depletion layer or an accumulation layer is not easily formed, compared with the case of a resistor made of polycrystalline silicon. Also, the stability of the reference voltage with respect to a variation in environmental temperature, and the stability of the reference voltage to be output with respect to a change in the potential of the circuit driving voltage can be dramatically increased.

In this reference voltage generating circuit, each of the resistors formed with the metal thin film includes a wiring pattern and an insulating film that is formed on the wiring pattern and has connecting holes at locations corresponding to connecting portions of the wiring pattern. Also, the metal thin film is ohmically connected to the connecting portions of the wiring pattern via the connecting holes.

In this structure, each of the resistors includes a wiring pattern and an insulating film that is formed on the wiring pattern and has connecting holes at the locations corresponding to the connection portions of the wiring pattern. Furthermore, the CrSi thin film is ohmically connected to the connection portions of the wiring pattern via the connecting holes. With this structure, a depletion layer or an accumulation layer cannot be easily formed, compared with the case of a resistor made of polycrystalline silicon. Also, the stability of the reference voltage with respect to a variation in environmental temperature, and the stability of the reference voltage to be output with respect to a change in the potential of the circuit driving voltage can be dramatically increased.

In this reference voltage generating circuit, a native oxide film is removed from the inner surface of each of the connecting holes that is in contact with the metal thin film, and another native oxide film is removed from the surface of the wiring pattern in contact with the metal thin film at the bottom of each of the connecting holes.

In this structure, a native oxide film is removed from the inner surface of each of the connecting holes that is in contact with the CrSi thin film, and another native oxide film is removed from the surface of the wiring pattern in contact with the CrSi thin film via the connecting holes. By doing so, the variation in resistance due to the growth of oxide film with time can be reduced. Accordingly, even after a certain period of time has passed, the stability of the reference voltage with respect to a variation in environmental temperature, and the stability of the reference voltage to be output with respect to a change in the potential of the circuit driving voltage can be increased more effectively than in the case of a resistor made of polycrystalline silicon.

In this reference voltage generating circuit, a refractory metal film is interposed between the metal thin film and the connecting portions of the wiring pattern.

As the refractory metal film is interposed between the metal thin film and the connecting portions of the wiring pattern, the resistance values do not vary with the heat generated in the heating process performed during the manufacturing procedures and in the actual usage. Thus, resistors with desired resistance values can be employed in this reference voltage generating circuit. Accordingly, even after a certain period of time has passed, the stability of the reference voltage with respect to a variation in environmental temperature, and the stability of the reference voltage to be output with respect to a change in the potential of the circuit driving voltage can be increased more effectively than in the case of a resistor made of polycrystalline silicon.

In this reference voltage generating circuit, the wiring pattern is formed with a metal material pattern and a refractory metal film that is formed on the metal material pattern.

As the wiring pattern is formed with a metal material pattern and a refractory metal film that is formed on the upper surface of the metal material pattern, the resistance values do not vary with the heat generated in the heating process performed during the manufacturing procedures and in the actual usage. Thus, resistors with desired resistance values can be employed in this reference voltage generating circuit. Accordingly, even after a certain period of time has passed, the stability of the reference voltage with respect to a variation in environmental temperature, and the stability of the reference voltage to be output with respect to a change in the potential of the circuit driving voltage can be increased more effectively than in the case of a resistor made of polycrystalline silicon.

In this reference voltage generating circuit, the wiring pattern is formed with a polysilicon pattern and a refractory metal film that is formed on the polysilicon pattern.

As the wiring pattern is formed with a polysilicon pattern and a refractory metal film that is formed on the upper surface of the polysilicon pattern, the resistance values do not vary with the heat generated in the heating process performed during the manufacturing procedures and in the actual usage. Thus, resistors with desired resistance values can be employed in this reference voltage generating circuit. Accordingly, even after a certain period of time has passed, the stability of the reference voltage with respect to a variation in environmental temperature, and the stability of the reference voltage to be output with respect to a change in the potential of the circuit driving voltage can be increased more effectively than in the case of a resistor made of polycrystalline silicon.

In this reference voltage generating circuit, the first power supply circuit has a field effect transistor with a high-concentration n-type gate and a field effect transistor with a high-concentration p-type gate that are connected in series.

As the first power supply circuit has a field effect transistor with a high-concentration n-type gate and a field effect transistor with a high-concentration p-type gate that are connected in series, and the resistors are formed with metal thin film, a depletion layer or an accumulation layer cannot be easily formed, compared with the case of a resistor made of polycrystalline silicon. Also, the stability of the reference voltage with respect to a variation in environmental temperature, and the stability of the reference voltage to be output with respect to a change in the potential of the circuit driving voltage can be dramatically increased.

In this reference voltage generating circuit, the second power supply circuit has a field effect transistor with a high-concentration p-type gate and a field effect transistor with a low-concentration p-type gate that are connected in series.

As the second power supply circuit has a field effect transistor with a high-concentration p-type gate and a field effect transistor with a low-concentration p-type gate that are connected in series, and the resistors are formed with metal thin film, a depletion layer or an accumulation layer cannot be easily formed, compared with the case of a resistor made of polycrystalline silicon. Also, the stability of the reference voltage with respect to a variation in environmental temperature, and the stability of the reference voltage to be output with respect to a change in the potential of the circuit driving voltage can be dramatically increased.

In this reference voltage generating circuit, the second power supply circuit has a field effect transistor with a high-concentration n-type gate and a field effect transistor with a low-concentration n-type gate that are connected in series.

As the second power supply circuit has a field effect transistor with a high-concentration n-type gate and a field effect transistor with a low-concentration n-type gate that are connected in series, and the resistors are formed with metal thin film, a depletion layer or an accumulation layer cannot be easily formed, compared with the case of a resistor made of polycrystalline silicon. Also, the stability of the reference voltage with respect to a variation in environmental temperature, and the stability of the reference voltage to be output with respect to a change in the potential of the circuit driving voltage can be dramatically increased.

The above and other objects, features, and advantages of the present invention will become more apparent from the following detailed description taken in conjunction with the accompanying drawings.

DESCRIPTION OF THE PREFERRED EMBODIMENTS

The following is a description of embodiments of the present invention, with reference to the accompanying drawings.

1) First Embodiment

Figure 1:
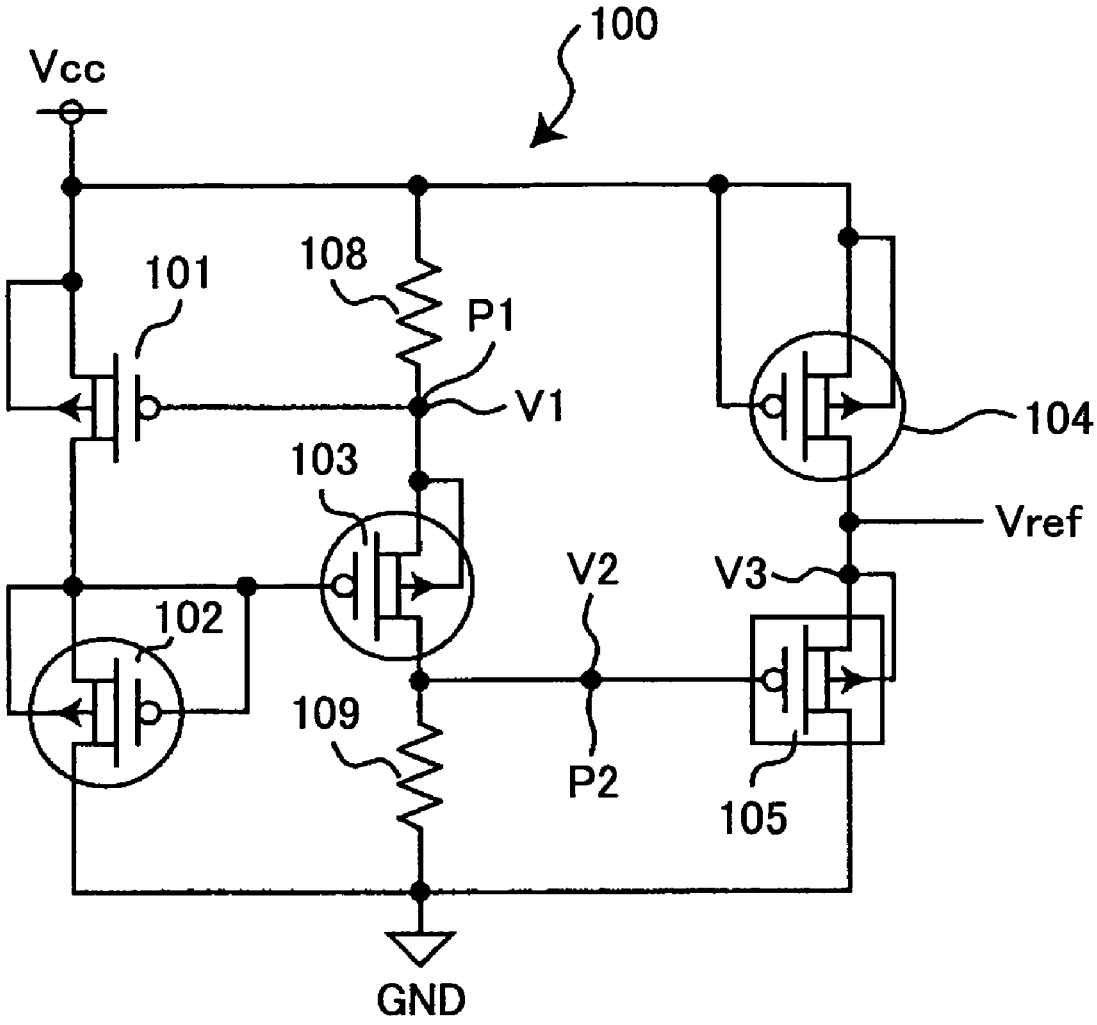
FIG. 1 illustrates the structure of a reference voltage generating circuit in accordance with the present invention.
Figure 15:
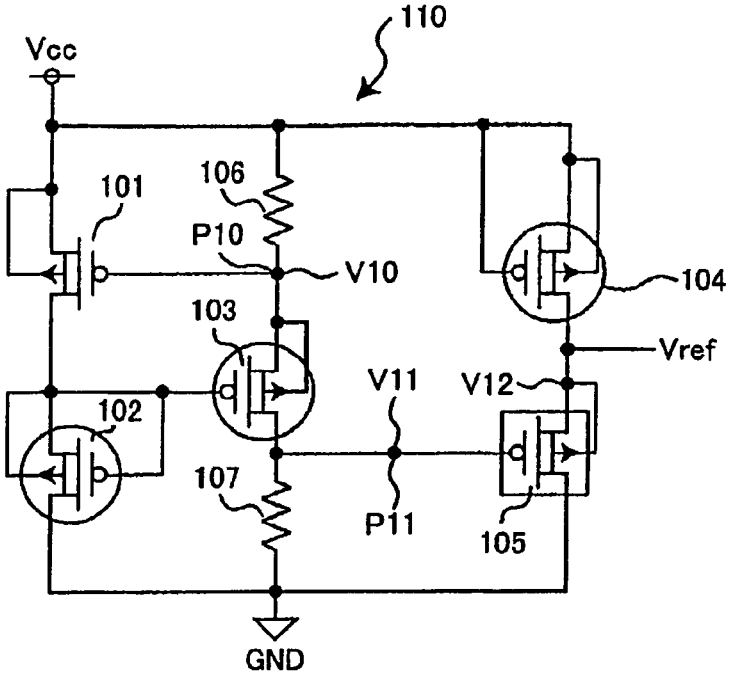
FIG.15 A (PRIOR ART)
FIGS. 15A and 15B are circuit diagrams illustrating conventional reference voltage generating circuits.

FIG. 1 illustrates the structure of a reference voltage generating circuit 100 in accordance with a first embodiment of the present invention. The reference voltage generating circuit 100 characteristically has resistors 108 and 109 that exhibit stable resistance values with respect to variation in environmental temperature, instead of the polycrystalline silicon resistors 106 and 107 that are employed in the conventional reference voltage generating circuit 110 illustrated in FIG. 15A. Except for the resistors 108 and 109, the reference voltage generating circuit 100 has the same structure as the conventional reference voltage generating circuit 110, and the components of the reference voltage generating circuit 100 are denoted by the same reference numerals as those of the conventional reference voltage generating circuit 110.

The reference voltage generating circuit 100 includes p-channel field effect transistors (hereinafter referred to simply as FETs) 101 through 105, and the resistors 108 and 109. The FETs 101, 102, 104, and 105 have the same substrate-doping and channel-doping impurity concentrations, and are formed in the n-well of a p-type substrate. The substrate potential of each transistor is set at the same value as the source potential.

The FET 101 has an n-type gate that is doped with a high-concentration impurity (hereinafter referred to simply as the high-concentration n-type gate), and the FET 102 has a p-type gate that is doped with a high-concentration impurity (hereinafter referred to simply as the high-concentration p-type gate). The FET 101 and the FET 102 are designed to have the ratio (S=W/L) of the channel width W to the channel length L at the same value.

The FET 104 has a high-concentration p-type gate, and the FET 105 has a p-type gate that is doped with a low-concentration impurity (hereinafter referred to simply as the low-concentration p-type gate). The FETs 104 and 105 are designed to have the same ratio (S=W/L) of the channel width W to the channel length L.

Potential is supplied to the gate of the FET 101 from a source follower circuit that includes a resistance dividing circuit formed with the FET 108 having a high-concentration p-type gate and the two resistors 108 and 109 that are connected in series. The gate of the FET 102 and the gate of the FET 103 are connected to each other. The source and the gate of the FET 103 are connected to each other. The gate of the FET 101 is connected to the connection point between the source of the FET 103 and the resistor 108 (the point P1 representing potential V1 in FIG. 1). The drain of the FET 103 is connected to the gate of the FET 105.

The FET 102 has the source and the gate connected to each other, and functions as a constant current source to supply constant current to the FET 101, to which the FET 102 is series-connected. In this structure, the potential between the source and the gate of the FET 101 that is calculated by subtracting the potential V1 from supply voltage Vcc is Vpn (=Vcc−V1). Meanwhile, potential V2 is represented as (the resistance value of the resistor 109/the resistance value of the resistor 108)×Vpn.

The FET 104 has the source and the gate connected to each other, and functions as a constant current source to supply constant current to the FET 105, to which the FET 104 is series-connected. With the potential between the source and the gate of the FET 105 being Vnn, the source potential V3 of the FET 105 is represented as V2+Vnn=(the resistance value of the resistor 109/the resistance value of the resistor 108)× Vpn+Vnn (=Vref).

The FET 101 and the FET 102 that are connected in series form a first power supply circuit that exhibits a negative temperature coefficient with respect to a variation in environmental temperature. Meanwhile, the FET 104 and the FET 105 that are connected in series form a second power supply circuit that exhibits a positive temperature coefficient with respect to a variation in environmental temperature. The resistance values of the resistor 108 and the resistor 109, which form the resistance dividing circuit in the source follower circuit, are adjusted by a trimming technique, for example. By doing so, the deviation in the negative temperature coefficient is adjusted, and the positive and negative temperature coefficients are cancelled. In this manner, a circuit that compensates the temperature characteristics and outputs a reference voltage Vref invariable with variations in environmental temperature is formed.

The deviations in the temperature coefficients of the respective circuits can be adjusted by changing the impurity concentrations of the high-concentration n-type gate of the FET 101, the high-concentration p-type gates of the FETs 102, 103, and 104, and the low-concentration p-type gate of the FET 105, as well as the values of the resistors 108 and 109.

2) Resistors 108 and 109

The resistor 108 and the resistor 109 that form the resistance dividing circuit in the reference voltage generating circuit 100 each have a semiconductor structure that includes: wiring patterns; an insulating film that is provided on the wiring patterns and has connecting holes at the locations corresponding to the connecting portions of the wiring patterns; and a metal thin film that is ohmically connected to the connecting portions of the wiring patterns via the connecting holes. Having the metal thin film as a resistor, each of the resistors 108 and 109 exhibits a more stable resistance value than a polycrystalline-silicon resistor with respect to a variation in environmental temperature, and the resistance value is invariable under the same temperature conditions. This is because, unlike a case with a resistor made of polycrystalline silicon, a depletion layer or an accumulation layer is not easily formed, and the resistance value does not vary in a wide range, even if the difference between the bias voltage applied to the resistor and the bias voltage applied the conductor adjacent to the resistor becomes great.

The resistor 108 and the resistor 109 have the same structures, are manufactured by the same procedures, and exhibit the same resistance characteristics. In the following, the resistor 108 will be described in greater detail. FIGS. 2A through 2F and FIGS. 3A through 3E illustrate the procedures for manufacturing the resistor 108. FIG. 3E shows the resistor 108 as a complete structure. In FIG. 3E, circuit devices (transistors and capacitive devices) that do not concern the explanation of the manufacturing procedures are not shown.

In the following, the resistor 108 as a complete structure shown in FIG. 3E will be first described briefly, and the procedures for manufacturing the resistor 108 will then be described in detail, with reference to FIGS. 2A through 2F and FIGS. 3A through 3E. After the description of the manufacturing method, the characteristics of the resistor 108, other methods of manufacturing the resistor 108, and the advantages of utilizing those methods will be described.

A device isolating oxide film 2 is formed on part of a silicon substrate 1. A first interlayer insulating film (a base insulating film) 3 that is made of BPSG film or PSG (phosphor-silicate glass) film is formed on the silicon substrate 1 including the formation region of the device isolating oxide film 2. A wiring pattern 6 that consists of a metal wiring pattern 4 and a refractory metal film 5 is formed on the first interlayer insulating film 3. The refractory metal film 5 is formed on the surface of the metal material pattern 4. The metal material pattern 4 may be made of AlSiCu film, for example. The refractory metal film 5 may be made of TiN film, for example, and functions as a barrier film that also serves as a reflection preventing film.

An opening 7 is formed in the wiring pattern 6 on the device isolating oxide film 2. A plasma CVD oxide film 8, a SOG (spin on glass) film 9, and a plasma CVD oxide film 10 are formed in this order on the wiring pattern 6 including the opening 7. These three films 8 through 10 will be hereinafter referred to as a second interlayer insulating film 11. In the second interlayer insulating film 11, connecting holes 12 and 13 are formed at the locations to be the end portions of a metal thin-film resistor or at the outer peripheral locations immediately above the opening 7.

On the second interlayer insulating film (an insulating film) 11, a CrSi thin-film resistor (a metal thin-film resistor) 15 is formed over the region between the connecting holes 12 and 13, the inner walls of the connecting holes 12 and 13, and the wiring pattern 6. Both end portions of the CrSi thin-film resistor 15 are ohmically connected to each other with the wiring pattern 6 inside the connecting holes 12 and 13.

A silicon oxide film 16 and a silicon nitride film 17 are formed in this order as a passivation film 18 on the second interlayer insulating film 11 including the formation region of the CrSi thin-film resistor 15.

Referring to FIGS. 2A through 2F and FIGS. 3A through 3E, the method of manufacturing the resistor 108 will be described in order (steps S1 through S11).

(Step S1)

Figure 2A:
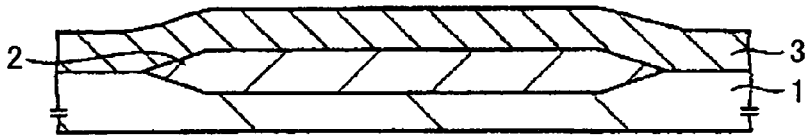
FIGS. 2A through 2F illustrate a method of manufacturing a resistor to be used in the reference voltage generating circuit.

Referring first to FIG. 2A, using an atmospheric-pressure CVD device, for example, the first interlayer insulating film 3 that is made of BPSG film or PSG film with a film thickness of 8000 Å is formed on the wafer-like silicon substrate 1 having the device isolating oxide film 2 and a transistor device (not shown) formed thereon. After that, the surface of the first interlayer insulating film 3 is smoothed through thermal treatment such as reflowing.

(Step S2)

Figure 2B:
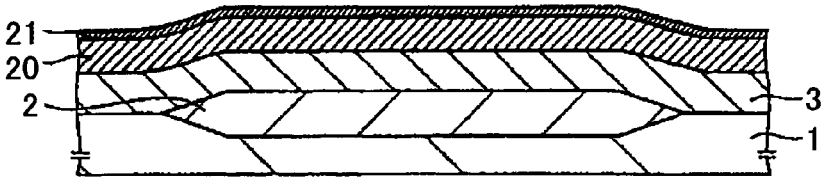

Referring now to FIG. 2B, using a DC magnetron sputtering device, for example, a wiring metal film 20 that is made of AlSiCu film with a film thickness of approximately 5000 Å is formed on the first interlayer insulating film 3. A refractory metal (TiN) film 21 with a film thickness of approximately 800 Å is then formed as a reflection preventing film.

Figure 2C:
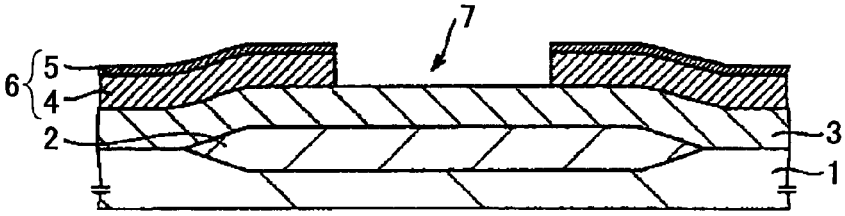

As shown in FIG. 2C, in a later procedure, the wiring metal film 20 and the refractory metal film 21 are processed to form the metal material pattern 4 and the refractory metal film 5 of the wiring pattern 6. Also, the refractory metal film 21 functions as a barrier film for stabilizing the contact resistance with the metal thin-film resistor. Therefore, the refractory metal film 21 should preferably be formed immediately after the formation of the wiring metal film 20 in the same vacuum.

(Step S3)

Referring now to FIG. 2C, patterning (partial removal) is performed on the refractory metal film 21 and the wiring metal film 20 by a known photolithography technique or a known etching technique. By doing so, the opening 7 is formed, and the wiring pattern 6 that consists of the metal wiring pattern 4 and the refractory metal film 5 is formed. When the patterning is performed, the refractory metal film 21 functions as a reflection preventing film. Accordingly, expanding or thinning of the resist pattern that is used for defining the formation region of the wiring pattern 6 can be minimized.

At this stage, a metal thin-film resistor (a CrSi thin film 14) is yet to be formed, and the base film for the wiring pattern 6 is formed by the first interlayer insulating film 3. Thus, the patterning of the refractory metal film 21 and the wiring metal film 20 can be sufficiently performed by a dry etching technique, and a more minute circuit structure can be obtained, compared with a case using a wet etching technique.

(Step S4)

Figure 2D:
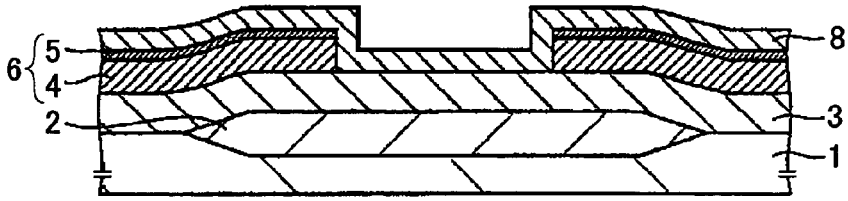

Referring now to FIG. 2D, by a known plasma CVD method, the plasma CVD oxide film 8 with a film thickness of 6000 Å is formed on the first interlayer insulating film 3 including the formation region of the wiring pattern 6.

(Step S5)

Figure 2E:
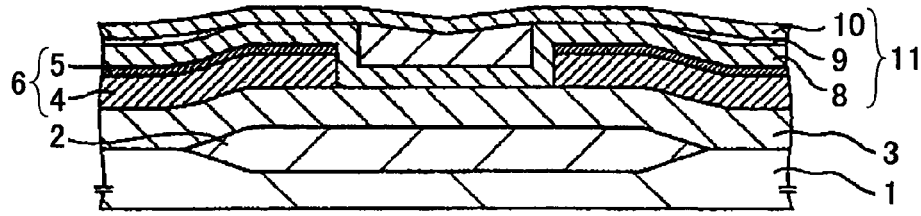

Referring now to FIG. 2E, coating and etchback on SOG are performed to form and smooth the SOG film 9 on the plasma CVD oxide film 8. The plasma CVD oxide film 10 with a film thickness of approximately 2000 Å is formed to prevent diffusion of the components of the SOG film 9. Hereinafter, the plasma CVD oxide film 8, the SOG film 9, and the plasma CVD oxide film 10 will be collectively referred to as the second interlayer insulating film 11.

(Step S6)

Figure 2F:
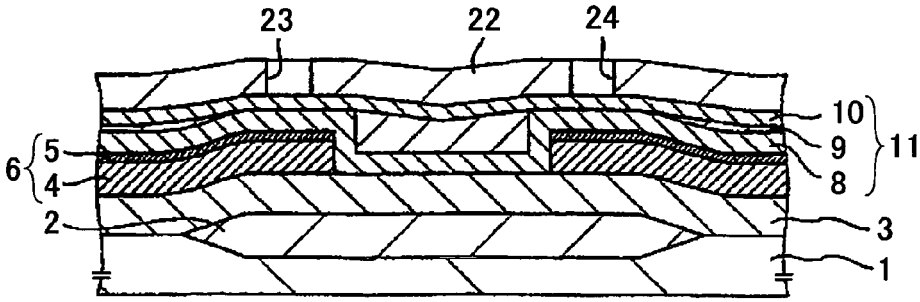

Referring now to FIG. 2F, by a known photolithography technique, a resist pattern 22 is formed at the locations corresponding to the end portions of the metal thin-film resistor on the second interlayer insulating film 11, or at the outer peripheral location immediately above the opening 7 formed in the wiring pattern 6. Two holes 23 and 24 are then opened in the resist pattern 22 to form the two connecting holes 12 and 13.

(Step S7)

Figure 3A:
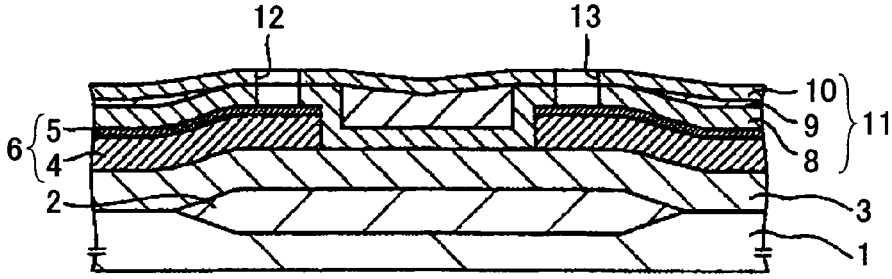
FIGS. 3A through 3E illustrate the method of manufacturing a resistor to be used in the reference voltage generating circuit.

Referring now to FIG. 3A, by a known parallel-plate plasma etching device, for example, the connecting holes 12 and 13 are formed under the conditions that the RF power is 700 W, the amount of Ar is 500 sccm (standard cc/minute), the amount of $CHF_3$ is 500 sccm, the amount of $CF_4$ is 500 sccm, and the pressure is 3.5 Torr, with the resist pattern 22 serving as a mask with the holes 23 and 24. On the bottom surfaces of the connecting holes 12 and 13, the refractory metal film 5 remains as reflection preventing films and barrier layers with a film thickness of approximately 600 Å. After the formation of the connecting holes 12 and 13, the resist pattern 22 is removed.

After the formation of the connecting holes 12 and 13, the byproduct sticking to the side walls of the connecting holes 12 and 13 may be removed by an etching process. Also, to improve the step coverage of the metal thin-film resistor inside the connecting holes 12 and 13, an etching process that combines a taper-etching technique, a wet etching technique, and a dry etching technique, may be employed. By doing so, the shapes of the connecting holes 12 and 13 can be made better.

In Step S7, the conditions for performing plasma etching are optimized so as to make the etching rate of the refractory metal film 5 lower than the etching rate of the second interlayer insulating film 11. Accordingly, while an increase in film thickness is prevented at the time of the formation of the refractory metal film 5, the refractory metal film 5 with a sufficient thickness can remain on the bottom surfaces of the connecting holes 12 and 13.

Also in Step S7, when the connecting holes 12 and 13 are formed prior to the formation of the metal thin-film resistor, there are no restrictions due to the thinness of the metal thin-film resistor, which is greatly advantageous. Accordingly, a dry etching technique that is more suitable for producing a minute circuit structure than a wet etching technique can be employed to form the connecting holes 12 and 13.

(Step S8)

Figure 3B:
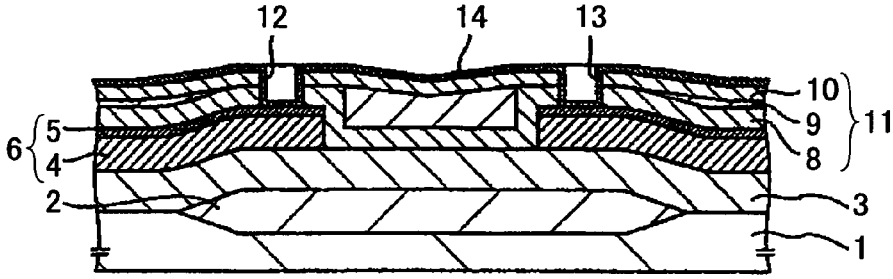

Referring now to FIG. 3B, using the Ar sputtering chamber of a multi-chamber sputtering device, for example, Ar sputter-etching is performed on the surface of the second interlayer insulating film 11 including the insides of the connecting holes 12 and 13 in a vacuum, under the conditions that the DC bias is 1250 V, the amount of Ar is 20 sccm, the pressure is 8.5 mTorr, and the processing time is 20 seconds. The conditions for performing the Ar sputter-etching are the same as the conditions for removing a thermal oxide film of approximately 50 Å in thickness in a wet atmosphere at 1000° C. After the above procedure, the film thickness of the refractory metal film 5 remaining on the bottom surfaces of the connecting holes 12 and 13 is approximately 500 Å.

Immediately after the Ar sputter-etching, the CrSi thin film (a metal thin film) 14 to be a resistor is formed in the vacuum maintained from the Ar sputter-etching process. More specifically, after the silicon wafer is transferred to a sputter chamber provided with a CrSi target from the Ar sputter-etching chamber, an operation using the CrSi target of 80/20 wt % in the Si/Cr ratio is performed under the conditions that the DC power is 0.7 kw, the amount of Ar is 85 sccm, and the processing time is 9 seconds. Through this operation, the CrSi thin film 14 with a film thickness of approximately 50 Å is formed on the surface of the second interlayer insulating film 11 including the insides of the connecting holes 12 and 13.

Since the Ar sputter-etching is performed on the second interlayer insulating film 11 including the insides of the connecting holes 12 and 13 prior to the formation of the CrSi thin film 14, the insides of the connecting holes 12 and 13 can be cleansed, and a very small amount of native oxide film formed on the surfaces of the refractory metal film 9 at the bottoms of the connecting holes 12 and 13 can be removed. Accordingly, excellent ohmic connection can be established between the wiring pattern 6 and the CrSi thin film 14.

Furthermore, the base-film dependency of the CrSi thin-film resistor (15) that is to be obtained from the CrSi thin film 14 in a later procedure can be reduced by the Ar sputter-etching.

(Step S9)

Figure 3C:
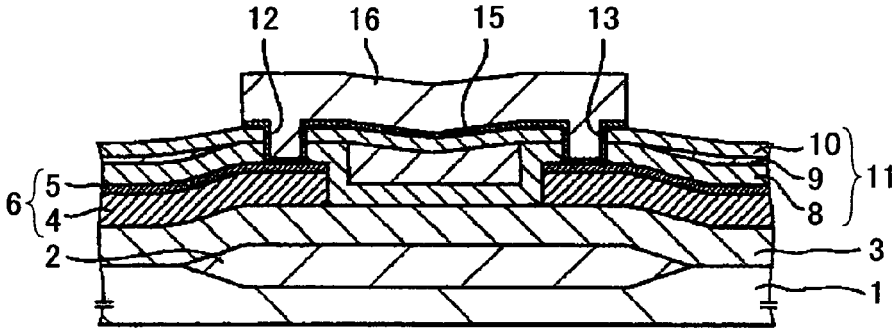

Referring now to FIG. 3C, by a known photolithography technique, a resist pattern 16 for defining the formation region of the metal thin-film resistor (15) is formed on the CrSi thin film 14. Using a RIE (reactive ion etching) device, for example, the CrSi thin film 14 is patterned to form the CrSi thin film resistor 15, with the resist pattern 16 serving as a mask.

(Step S10)

Figure 3D:
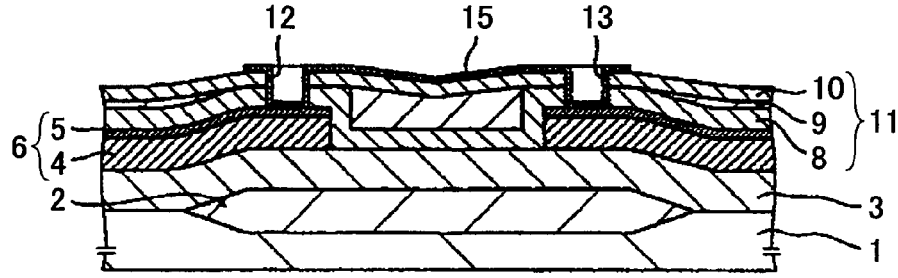
Figure 3E:
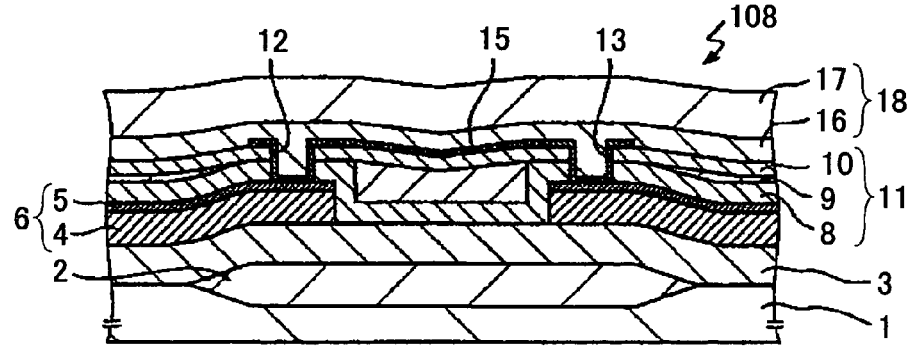

Referring now to FIG. 3D, the resist pattern 16 is removed after the formation of the CrSi thin-film resistor 15. The CrSi thin-film resistor 15 is electrically connected to the wiring pattern 6 inside the connecting holes 12 and 13. This is advantageous, because the metal oxide film on the surface of the CrSi thin-film resistor 15 does not need to be removed so as to establish ohmic connection on the upper surface of the resistor 108 that is the end product.

(Step S11)

Referring now to FIG. 3E, by a plasma CVD technique, for example, the silicon oxide film 16 and the silicon nitride film 17 are formed in this order as the passivation film 18 on the second interlayer insulating film 11 including the formation region of the CrSi thin-film resistor 15.

Through the above described procedures of Step S1 through Step S11, the resistor 108 is obtained.

By the above method of manufacturing the resistor 108, the CrSi thin-film resistor 15 is formed after the formation of the wiring pattern 6 and the connecting holes 12 and 13, and the ohmic connection between the CrSi thin-film resistor 15 and the wiring pattern 6 is established inside the connecting holes 12 and 13. This manufacturing method is advantageous in that the patterning by a wet etching technique is not necessary after the patterning of the CrSi thin-film resistor 15.

Furthermore, the contact face between the CrSi thin-film resistor 15 and the wiring pattern 6 is not exposed to the air. Accordingly, stable ohmic connection can be established between the CrSi thin-film resistor 15 and the wiring pattern 6, even though the oxide film is not removed from the surface of the CrSi thin-film resistor 15 and a barrier film is not formed to prevent inadvertent film removal through etching.

Thus, the CrSi thin-film resistor 15 can have a more minute structure and a more stable resistance value, regardless of the film thickness, without an increase in the number of manufacturing procedures.

Furthermore, the refractory metal film 5 that functions as a barrier film is interposed between the CrSi thin-film resistor 15 and the metal material pattern 4. Accordingly, the variation in contact resistance between the CrSi thin-film resistor 15 and the wiring pattern 6 can be reduced, and the resistance value of the CrSi thin-film resistor 15 can be stabilized. Thus, the yield of the resistor 108 as a product can be increased.

Also, the refractory metal film 5 functions as a reflection preventing film as well as a barrier film. Accordingly, the number of manufacturing procedures and the production cost can be reduced, unlike the case utilizing the conventional manufacturing method by which a barrier film is formed separately. Thus, the contact resistance between the wiring pattern 6 and the CrSi thin-film resistor 15 as a metal thin-film resistor can be stabilized.

3) Characteristics of the Resistor 108

In a resistor that is made of polycrystalline silicon, a depletion layer or an accumulation layer is formed due to the difference between the bias voltage applied to an adjacent conductor and the bias voltage applied to the resistor, and the resistance value of the resistor varies. In the resistor 108 that is produced through the procedures of Step S1 through Step S1, on the other hand, a depletion layer or an accumulation layer is not easily formed, and the variation in resistance is small under the same conditions as the above.

Figure 4:
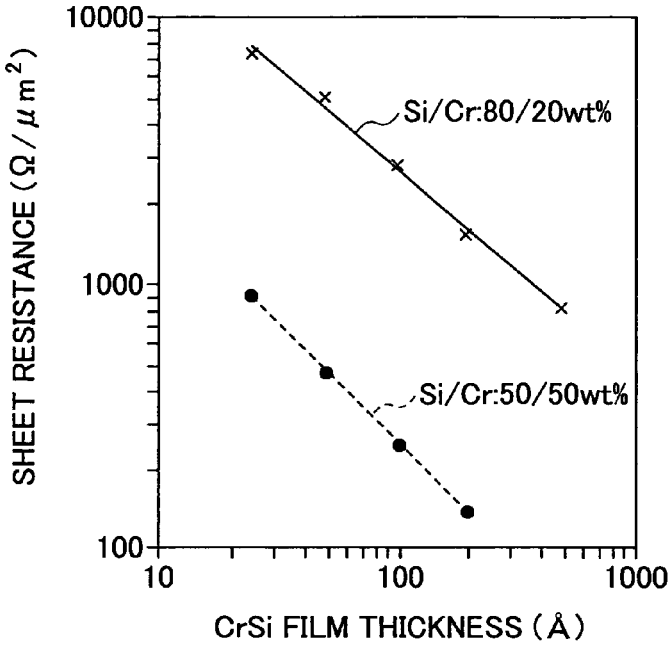
FIG. 4 shows the characteristics of resistors formed with metal thin films.
Figure 5:
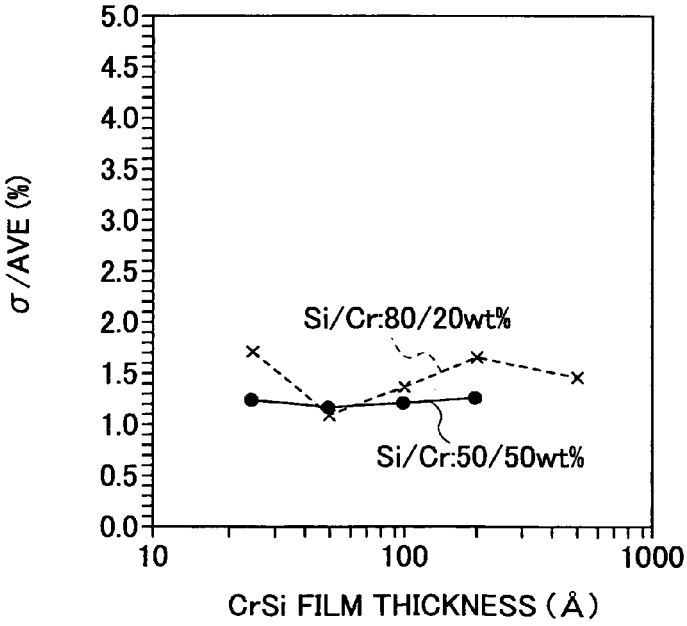
FIG. 5 shows the characteristics of resistors formed with metal thin films.

Referring to FIGS. 4 and 5, the characteristics of the resistor 108 manufactured through the procedures of Step S1 through Step S11 are now described. FIG. 4 is a graph showing the relationship between the film thickness (Å) and the sheet resistance ($\Omega/\mu m^2$) of the metal thin-film resistor (the CrSi thin-film resistor 15) of the resistor 108. FIG. 5 is a graph showing the relationship between the CrSi film thickness and the value ($\sigma$/AVE) obtained by dividing the standard deviation ($\sigma$) in the measurement results of the sheet resistance of the metal thin-film resistor (the CrSi thin-film resistor 15) at 63 locations in the wafer plane by the average value (AVE).

To produce the graphs of FIGS. 4 and 5, using a multi-chamber sputtering device, samples of resistors 108 having CrSi thin-film resistors of 25 Å to 500 Å in film thickness were prepared, while the deposition time was adjusted for the respective samples. More specifically, the samples were manufactured under the conditions that the DC power was 0.7 KW, the amount of Ar was 85 sccm, and the pressure was 8.5 mTorr, with the Ci/Sr ratio being 50/50 wt % (first targets) and 80/20 wt % (second targets). The number of samples with first targets was 4, and the number of samples with second targets was 5. A sample of 500 Å in film thickness with a first target was not prepared. In FIGS. 4 and 5, the dotted lines indicate the samples with first targets, and the solid lines indicate the samples with second targets.

For each of the samples, the Ar sputter-etching (Step S8) prior to the formation of a CrSi thin film was performed using a multi-chamber sputtering device only for 160 seconds, under the conditions that the DC bias was 1250 V, the amount of Ar was 20 sccm, and the pressure was 8.5 mTorr. The Ar stutter-etching was a process equivalent to the process for etching a thermal oxide film formed in a wet atmosphere at 1000° C., only by a thickness of approximately 400 Å.

In each of the samples, the wiring pattern 6 that was located under and connected to the CrSi thin-film resistor 15 as a metal thin-film resistor was made of AlSiCu film (the metal material pattern 4) of 5000 Å in film thickness. Also in each of the samples, the TiN film of the refractory metal film 5 did not remain on the bottoms of the connecting holes 12 and 13.

The sheet resistance ($\Omega/\mu m^2$) was measured by a two terminal method by which a current value was measured after applying a voltage of 1V to both ends of a resistor 108 among twenty belt-like patterns of 0.5 μm in width and 50 μm in length that were arranged at intervals of 0.5 μm. The surface size of each of the connecting holes 12 and 13 that connect the wiring pattern 6 as the metal wires to the CrSi thin-film resistor 15 was 0.6 μm×0.6 μm.

As can be seen from FIG. 4, the linearity between the film thickness and the sheet resistance is maintained, regardless of the compositions of the first targets (with the Si/Cr ratio of 50/50 wt %, indicated by the dotted lines) and the second targets (with the Si/Cr ratio of 80/20 wt %, indicated by the solid lines), even though the film thickness varied from 25 Å to 200 Å or over. By the above described manufacturing method, a metal thin-film resistor of a very small size that cannot be formed by the conventional method utilizing a wet etching technique can be manufactured.

Also, as can be seen from FIG. 5, the sheet resistance values at the 63 locations in the wafer plane are not affected by the film thicknesses of the samples with both the first targets (with the Si/Cr ratio of 50/50 wt %, indicated by the dotted lines) and the second targets (with the Si/Cr ratio of 80/20 wt %, indicated by the solid lines). Accordingly, by the above described manufacturing method, the patterns of minute and very thin metal thin-film resistors (CrSi thin-film resistors 15) can be constantly formed.

Figure 6A:
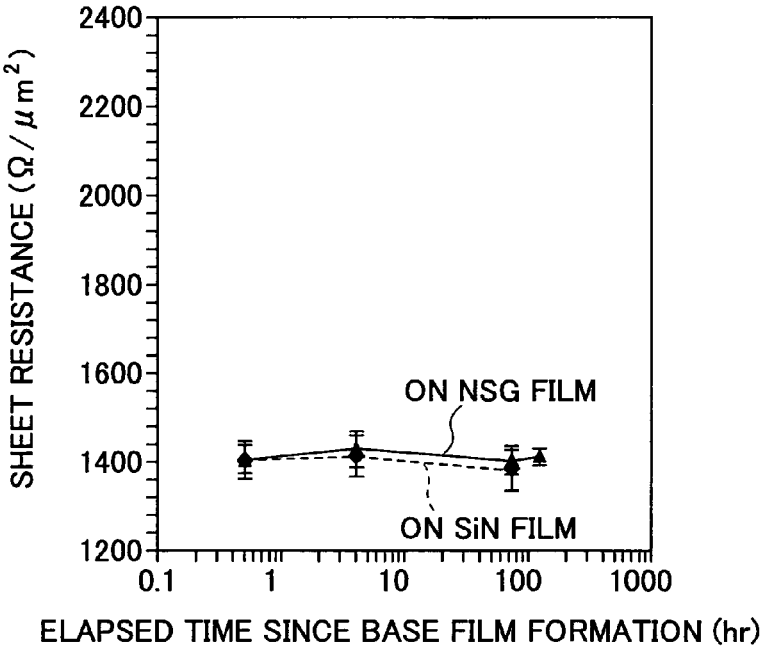
FIGS. 6A and 6B show the characteristics of resistors in accordance with the present invention.
Figure 6B:
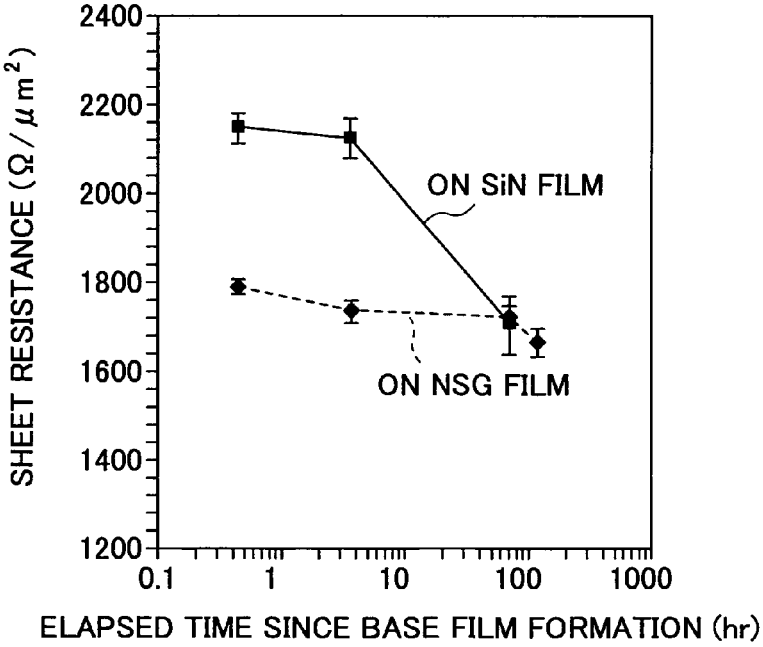

FIG. 6A is a graph showing the relationship between the sheet resistance ($\Omega/\mu m^2$) of the CrSi thin-film resistor 15 and the elapsed time (hr) since the formation of the base film for the CrSi thin-film resistor 15 in the case where the Ar sputter-etching was performed prior to the formation of the CrSi thin-film resistor 15 as a metal thin-film resistor. FIG. 6B is a graph showing the relationship between the sheet resistance and the elapsed time in the case where the Ar sputter-etching was performed after the formation of the CrSi thin-film resistor 15 as a metal thin-film resistor. In each of the graphs, the ordinate axis indicates the sheet resistance ($\Omega/\mu m^2$) of the CrSi thin-film resistor 15, while the abscissa axis indicates the elapsed time (hr) since the formation of the base film.

To produce the graphs of FIGS. 6A and 6B, two samples of the resistor 108 having the CrSi thin-film resistor 15 formed on a plasma SiN film and a plasma NSG (non-doped silicate glass) film that were formed with a film thickness of 2000 Å by a plasma CVD technique were prepared. The sheet resistance ($\Omega/\mu m^2$) of the CrSi thin-film resistor 15 of each of the two samples was measured by a four terminal method.

Using a parallel-plate plasma CVD device, the plasma SiN film as the base film was formed under the conditions that the temperature was 360° C., the pressure was 5.5 Torr, the RF power was 200 W, the amount of $SiH_4$ was 70 sccm, the amount of $N_2$ was 3500 sccm, and the amount of $NH_3$ was 40 sccm. Also, using a parallel-plate plasma CVD device, the plasma NSG film was formed under the conditions that the temperature was 400° C., the pressure was 3.0 Torr, the RF power was 250 W, the amount of $SiH_4$ was 16 sccm, and the amount of $N_2O$ was 1000 sccm.

Using a multi-chamber sputtering device, the CrSi thin-film resistor 15 with a film thickness of 100 Å was formed with a target having the SiCr ratio of 80/20 wt %, under the conditions that the DC power was 0.7 KW, the amount of Ar was 85 sccm, the pressure was 8.5 mTorr, and the deposition time was 13 seconds.

For the sample on which Ar sputter-etching was to be performed, the Ar sputter-etching was performed using a multi-chamber sputtering device only for 80 seconds, under the conditions that the DC bias was 1250 V, the amount of Ar was 20 sccm, and the pressure was 8.5 mTorr. This is equivalent to the process for etching a thermal oxide film formed in a wet atmosphere at 1000° C., only by 200 Å.

As can be seen from FIG. 6B, in the case where the Ar sputter-etching was not performed prior to the formation of the CrSi thin-film resistor 15, the sheet resistance greatly varied with the types of base films (a SiN film and a NSG film). Also, the sheet resistance was greatly affected by the time elapsed since the formation of the base film until the formation of the CrSi thin-film resistor 15. As can be seen from FIG. 6A, on the other hand, in the case where the Ar sputter-etching was performed, the characteristics of the sheet resistance of the CrSi thin-film resistor 15 were not much affected by the types of base films and the elapsed time.

As described in the explanation of Step S2, the wiring metal film 20 and the refractory metal film 21 are formed after the Ar sputter-etching process, so that the variation in resistance that is caused due to the time elapsed since the Ar sputter-etching and the different types of base films can be greatly reduced.

Also, the Ar sputter-etching does not only affect the base film but also stabilizes the resistance value of the CrSi thin-film resistor 15.

Figure 7:
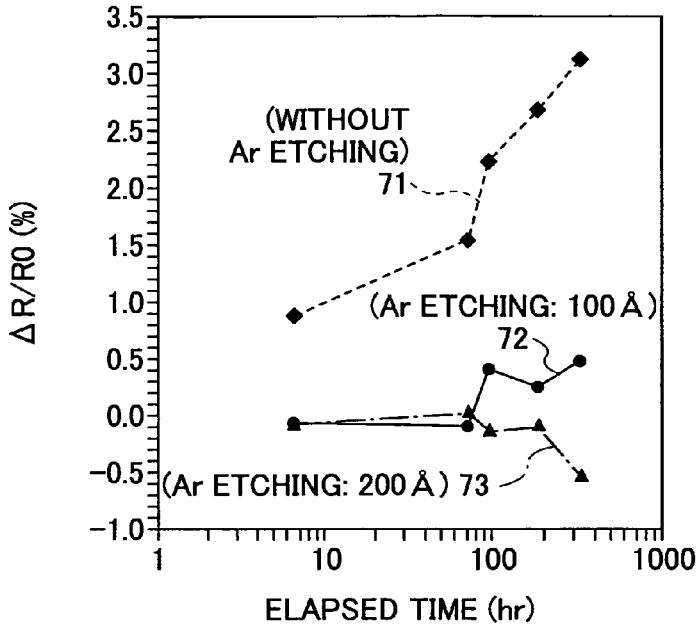
FIG. 7 shows the characteristics of resistors formed with metal thin films.

FIG. 7 shows the relationship between the time during which the CrSi thin-film resistor 15 of the resistor 108 was left in an atmosphere at a temperature of 25° C. with a humidity of 45% and the rate of change (ΔR/R0) in the sheet resistance with respect to the sheet resistance (R0) measured immediately after the formation of the CrSi thin-film resistor 15. In the graph of FIG. 7, the ordinate axis indicates the rate of change ΔR/R0%, while the abscissa axis indicates the left time (hr).

The base films and the CrSi thin-film resistors of the samples of the resistor 108 used in the experiments shown in FIG. 7 were formed under the same conditions as the samples of the resistor 108 used in the experiments shown in FIGS. 6A and 6B. There were three types of samples prepared: one that was formed without Ar sputter-etching (indicated by the dotted line 71 in FIG. 7); one with a thermal oxide film of a film thickness of 100 Å that was formed by performing Ar sputter-etching for 40 seconds (indicated by the solid line 72 in FIG. 7); and one with a thermal oxide film of a film thickness of 200 Å that was formed by performing Ar sputter-etching for 80 seconds (indicated by the dashed line 73 in FIG. 7). Hereinafter, the sample on which Ar sputter-etching was not performed will be referred to as the "sample without Ar etching", the sample of 100 Å in film thickness on which Ar sputter-etching was performed for 40 seconds will be referred to as the "100 Å sample with Ar etching", and the sample of 200 Å in film thickness on which Ar sputter-etching was performed for 80 seconds will be referred to as the "200 Å sample with Ar etching".

As can be seen from the graph of the sample without Ar etching, the resistance value increased as the time passed since the formation, and, when the sample was left over 300 hours, the resistance value varied 3% or more.

On the other hand, in the cases of the 100 Å sample with Ar etching and the 200 Å sample with Ar etching, the rate of change in the resistance value was greatly lowered, and, even when the samples were left over 300 hours, the resistance value always remained within the error range of ±1% of the sheet resistance measured immediately after the formation.

Further, as can be seen from the comparison between the 100 Å sample with Ar etching and the 200 Å sample with Ar etching, the amount of Ar sputter-etching did not greatly affect the results, and a small amount of etching was sufficient.

So far, the characteristics of the resistor 108 with respect to the influence of the base film on the sheet resistance and the influence of the time during which the samples were left in the air have been described. However, those effects are not limited to the CrSi thin-film resistors with the first targets (Si/Cr=50/50 wt %) and the second targets (Si/Cr=80/20 wt %). In fact, the same effects as above were achieved with all CrSi thin films and CrSiN films formed with targets having the Si/Cr ratio of 50/50 wt % to 90/10 wt %. Also, the Ar sputter-etching technique is not limited to the DC bias sputter-etching technique used in the above examples.

Figure 8:
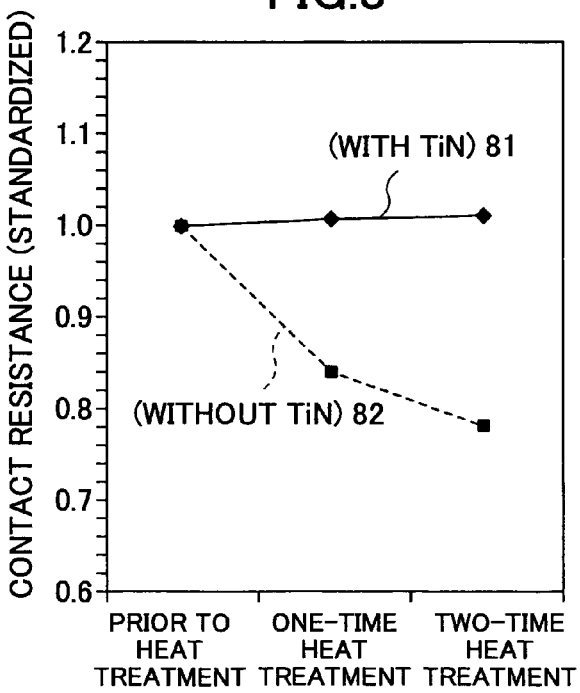
FIG. 8 shows the characteristics of resistors formed with metal thin films.

FIG. 8 shows the results of experiments on the variation in the contact resistance between the metal thin-film resistor and the metal wires due to thermal treatment performed on samples having the refractory metal film 5 remaining on the bottom of each connecting hole and samples having the refractory metal film 5 completely removed. In the graph of FIG. 8, the ordinate axis indicates values standardized with the contact resistance value prior to thermal treatment, while the abscissa axis indicates the number of times when thermal treatment is performed.

In the experiments shown in FIG. 8, the dry etching time for forming the connecting holes 12 and 13 was adjusted to obtain a sample of the resistor 108 having the refractory metal film 5 of approximately 500 Å in thickness remaining on the bottoms of the connecting holes 12 and 13, and a sample of the resistor 108 having the refractory metal film 5 completely removed. Here, TiN film was employed as the refractory metal film 5. The CrSi thin-film resistor 15 with a film thickness of 50 Å was formed under the conditions that the Si/Cr ratio was 80/20 wt %, the DC power was 0.7 KW, the amount of Ar was 85 sccm, the pressure was 8.5 mTorr, and the deposition time was 6 seconds.

The Ar sputter-etching prior to the formation of the CrSi thin-film resistor 15 was performed under the conditions that the DC bias was 1250 V, the amount of Ar was 20 sccm, the pressure was 8.5 mTorr, and the processing time was 160 seconds. This process is equivalent to the process for etching a thermal oxide film formed in a wet atmosphere at 1000° C., only by 400 Å. The surface size of each of the connecting holes 12 and 13 was 0.6 μm×0.6 μm. The contact resistance was measured by the four-terminal method.

For the samples of the resistor 108, 30-minute thermal treatment was performed in a nitrogen atmosphere at 350° C. so as to see how the characteristics of the contact resistance would change. For the sample of the resistor 108 having a TiN film as the refractory metal film 5 remaining on the bottom surfaces of the connecting holes 12 and 13 (the sample indicated by the solid line 81 "with TiN" in FIG. 8), the thermal treatment was performed twice, but the characteristics of the contact resistance remained the same as before the thermal treatment. On the other hand, for the sample having the TiN film completely removed (the sample indicated by the dotted line 82 "without TiN" in FIG. 8), the thermal treatment was also performed twice, and the value of the contact resistance varied 20% or more, compared with the value of the constant resistance prior to the thermal treatment. This implies that the TiN film used as the refractory metal film 5 functions as a barrier film for preventing a variation in resistance due to the interaction between the CrSi thin-film resistor 15 and the metal material pattern 4 of the wiring pattern 6.

As the TiN film used as the refractory metal film 5 is interposed between the CrSi thin-film resistor 15 and the metal material pattern 4, the variation in the contact resistance caused by thermal treatment such as sintering and CVD performed in the manufacturing procedures can be made vary small, and the variation in the contact resistance caused by thermal treatment such as soldering performed in the assembling process that is post processing can be prevented. Accordingly, the desired contact resistance can be constantly obtained, and the variations in the contact resistance before and after assembling can be prevented. Thus, more minute products and higher yield can be achieved.

By the method of manufacturing the resistor 108 illustrated in FIGS. 2A through 3E, the wiring metal film 20 and the refractory metal film 21 are formed successively in a vacuum in the procedure of Step S2. However, the present invention is not limited to this structure.

For example, in the case where the refractory metal film 21 is formed after the wiring metal film 20 is formed and exposed to the air, it is difficult to maintain electric conductivity between the wiring metal film 20 and the refractory metal film 21 due to the influence of the native oxide film formed on the surface of the wiring metal film 20. As described above, the wiring pattern 6 is formed with the metal material pattern 4 and the refractory metal film 5 that are formed by patterning the wiring metal film 20 and the refractory metal film 21. At the stage of forming the connecting holes 12 and 13 in the second interlayer insulating film 11 formed on the wiring pattern 6, the refractory metal film 5 is completely removed from the bottom surfaces of the connecting holes 12 and 13, so that excellent ohmic connection can be formed between the wiring pattern 6 and the CrSi thin-film resistor 15.

Also, in the procedure of Step S2, the film thickness of the refractory metal film 21 that functions as a reflection preventing film and a barrier film is 800 Å. However, the embodiments of the present invention are not limited to that. In general, a refractory metal film as a reflection preventing film has a film thickness of 500 Å or smaller. By the method of manufacturing the resistor 108 illustrated in FIGS. 2A through 3E, the film thickness of the refractory metal film 5 decreases by a small amount during the overetching process at the time of the formation of the connecting holes 12 and 13 (Step S7) and in the Ar sputter-etching process at the time of the formation of the metal thin film. Therefore, to leave the refractory metal film 5 as a stable barrier film on the bottom surfaces of the connecting holes 12 and 13, the refractory metal film 21 should preferably be formed with a film thickness of 500 Å or greater.

However, the conditions for the etching process to form the connecting holes 12 and 13, and the conditions for the Ar sputter-etching process may be optimized so as to minimize the decrease in the film thickness of the refractory metal film 5. In this manner, the refractory metal film 5 can function as a barrier film, even if the film thickness is 500 Å or smaller.

In the procedure of Step S8, Ar sputter-etching is performed immediately before the formation of the CrSi thin film 14. In the case where the refractory metal film 5 made of TiN as a barrier film remains on the bottom surfaces of the connecting holes 12 and 13, however, a native oxide film as strong as an AlSiCu film is not formed when the refractory metal film 5 is exposed to the air. Therefore, it is not necessary to perform Ar sputter-etching immediately before the formation of the CrSi thin film 14 so as to establish excellent ohmic connection between the CrSi thin film 14 and the wiring pattern 6. However, the resistance value of the CrSi thin-film resistor 15 can be more stabilized by performing Ar sputter-etching immediately before the formation of the CrSi thin film 14, as described with reference to FIG. 7. Therefore, it is more preferable to perform Ar sputter-etching.

In the resistor 108, the second interlayer insulating film 11 includes the SOG film 9 that is flattened by an etchback technique. However, the insulating film (or an insulating layer) to serve as the base film for the CrSi thin-film resistor 15 is not limited to that. As the insulating film to serve as the base film for the CrSi thin-film resistor 15, it is possible to employ an insulating film that is flattened by a known CMP (chemical mechanical polish) technique or a plasma CVD oxide film that is not flattened.

Among analog resistance elements, there are many cases in which the pairing and the matching, as well as TCR, are regarded as important factors. Especially in the case where a metal thin-film resistor (the metal thin-film resistor 15) of the resistor 108 is employed as an analog resistance element, it is more preferable to perform a flattening process on the second interlayer insulating film 11 that is to serve as the base film for the metal thin-film resistor.

Although the passivation film 18 is formed on the CrSi thin-film resistor 15 in the resistor 108, the present invention is not limited to such a structure. For example, an insulating film such as an interlayer insulating film to form a second metal wiring layer may be formed on the CrSi thin-film resistor 15.

4) Method of Manufacturing a Modification of the Resistor

Figure 9A:
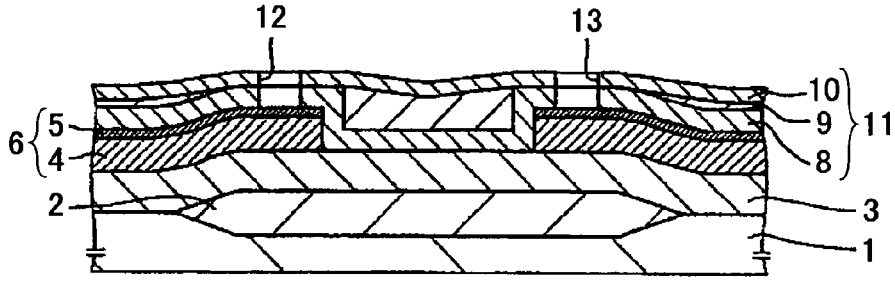
FIGS. 9A through 9D illustrate a method of manufacturing a modification of a resistor of the present invention.
Figure 9B:
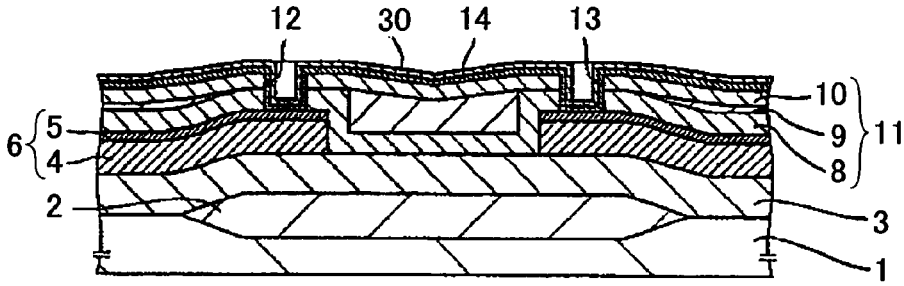
Figure 9C:
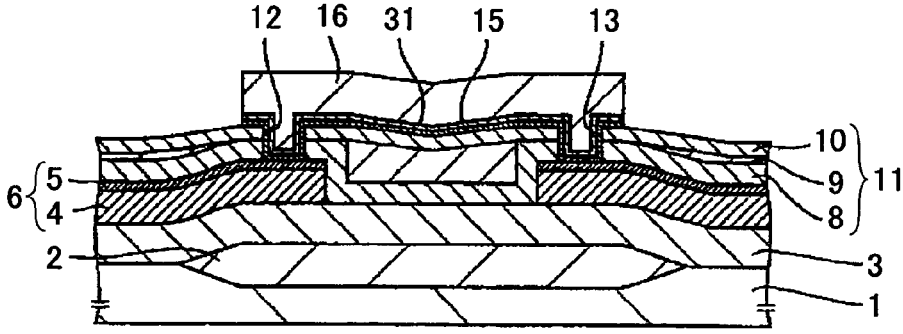
Figure 9D:
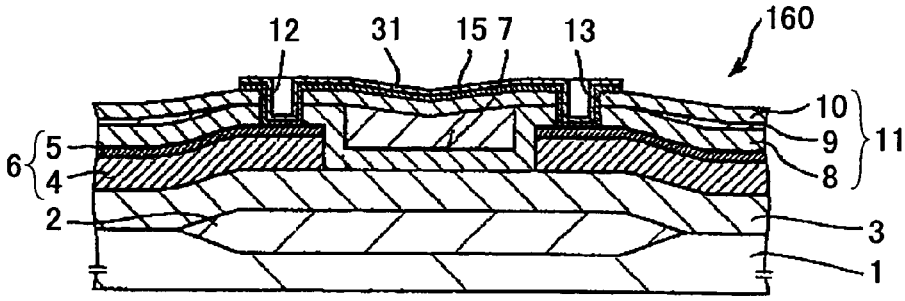

FIGS. 9A through 9D illustrate the method of manufacturing a resistor 160 that is a modification of the resistor 108. FIG. 9D shows the completion drawing of the resistor 160. In the actual resistor 160, a transistor device and a capacitive device are formed on the same substrate, but are not shown in FIGS. 9A through 9D. The same components as those of the resistor 108 illustrated in FIGS. 2A through 3E are denoted by the same reference numerals as those in FIGS. 2A through 3E, and explanation of them is omitted herein.

Referring first to FIG. 9D, the structure of the resistor 160 is described. A device isolating oxide film 2, a wiring pattern 6, and a second interlayer insulating film 11 are formed in this order on a silicon substrate 1. The wiring pattern 6 is formed by stacking a first interlayer insulating film 3, a metal material pattern 4, and a refractory metal film 5 in this order. The second interlayer insulating film 11 is formed by stacking a plasma CVD oxide film 8, a SOG film 9, and a plasma CVD oxide film 10 in this order. In the second interlayer insulating film 11, two connecting holes 12 and 13 are formed at locations corresponding to both end portions of the metal thin-film resistor, or at the outer peripheral portions located immediately above an opening 7 (see FIG. 2C) formed in the wiring pattern 6.

On the second interlayer insulating film 11, a CrSi thin-film resistor 15 is formed over the region between the connecting holes 12 and 13, the inner walls of the connecting holes 12 and 13, and the wiring pattern 6. A CrSiN film (a metal nitride film) 31 is formed on the upper surface of the CrSi thin-film resistor 15. A CrSiO film is not formed between the CrSi thin-film resistor 15 and the CrSiN film 31. Although not shown in FIG. 9D, an interlayer insulating film or a passivation film (equivalent to the passivation film 18 of the resistor 108 shown in FIG. 3E) is formed on the second interlayer insulating film 11 including the formation region of the CrSi thin-film resistor 15.

In the following, referring to FIGS. 9A through 9D, the method of manufacturing the resistor 160 is described.

(Step S20)

Referring to FIG. 9A, the wiring pattern 6 that is formed with the first interlayer insulating film 3, the metal wiring pattern 4, and the refractory metal film 5, and the second interlayer insulating film 11 that is formed with the plasma CVD oxide film 8, the SOG film 9, and the plasma CVD oxide film 10, are formed on the wafer-like silicon substrate 1 having the device isolating oxide film 2 formed thereon. The connecting holes 12 and 13 are then formed in the second interlayer insulating film 11. These procedures are the same as the procedures of Step S1 through Step S7 illustrated in FIGS. 2A through 2F and FIG. 3A.

(Step S21)

Referring now to FIG. 9B, the same procedure as the procedure of Step S8 illustrated in FIG. 3B is carried out. Using the Ar sputter-etching chamber of a multi-chamber sputtering device, for example, Ar sputter-etching is performed, in a vacuum, on the surface of the second interlayer insulating film 11 including the inner surfaces of the connecting holes 12 and 13. In the same vacuum, a CrSi thin film 14 for forming a metal thin-film resistor is formed.

Immediately after the formation of the CrSi thin film 14, a CrSiN film 30 is formed on the CrSi thin film 14 in the same vacuum. Here, the CrSiN film 30 with a film thickness of approximately 50 Å is formed on the CrSi thin film 14 using a CrSi target with a Si/Cr ratio of 80/20 wt %, under the conditions that the DC power is 0.7 KW, the amount of $Ar+N_2$ (the mixed gas of argon and nitrogen) is 85 sccm, the pressure is 8.5 mTorr, and the processing time is 6 seconds.

(Step S21)

Referring now to FIG. 9C, the same procedures as the procedure of Step S9 illustrated in FIG. 3C is carried out. More specifically, a resist pattern 16 for defining the formation region of the metal thin-film resistor is formed on the CrSiN film 30 by a known photolithography technique. Using a RIE (reactive ion etching) device, patterning (partial removal) is performed on the CrSiN film 30 and the CrSi thin film 14, with the resist pattern 16 serving as a mask. Thus, a lamination pattern that includes the CrSiN film 31 and the CrSi thin-film resistor 15 is formed.

(Step S22)

Referring now to FIG. 9D, after the formation of the lamination pattern formed with the CrSiN film 31 and the CrSi thin-film resistor 15, the resist pattern 16 is removed. Since the CrSi thin-film resistor 15 is electrically connected to the wiring pattern 6 as in the foregoing embodiment, it is not necessary to perform the metal oxide film removing process using a hydrofluoric solution on the surface of the CrSi thin-film resistor 15. Also, as the upper surface of the CrSi thin-film resistor 15 is covered with the CrSiN film 31, the upper surface of the CrSi thin-film resistor 15 is not oxidized even when exposed to an atmosphere containing oxygen, such as the air.

Although not shown in FIG. 9D, an interlayer insulating film or a passivation film (equivalent to the passivation film 18 shown in FIG. 3E) is formed on the second interlayer insulating film 11 including the formation region of the CrSi thin-film resistor 15 and the CrSiN film 31.

In general, a thin film made of a metal such as CrSi has high reactivity with oxygen, and therefore, the resistance value varies if the metal thin film is exposed to the air over a long period of time. In the resistor 160, the CrSiN film 31 is formed on the upper surface of the CrSi thin-film resistor 15, so as to prevent the upper surface of the CrSi thin-film resistor 15 from being exposed to the air and the resistance value of the CrSi thin-film resistor 15 from varying with time. At the stage of forming the CrSi thin film 14 for forming the CrSi thin-film resistor 15, the ohmic connection between the CrSi thin film 14 and the wiring pattern 6 is established. Accordingly, even if a new thin film is formed on the CrSi thin film 14, it does not affect the characteristics of the CrSi thin-film resistor 15.

Figure 10:
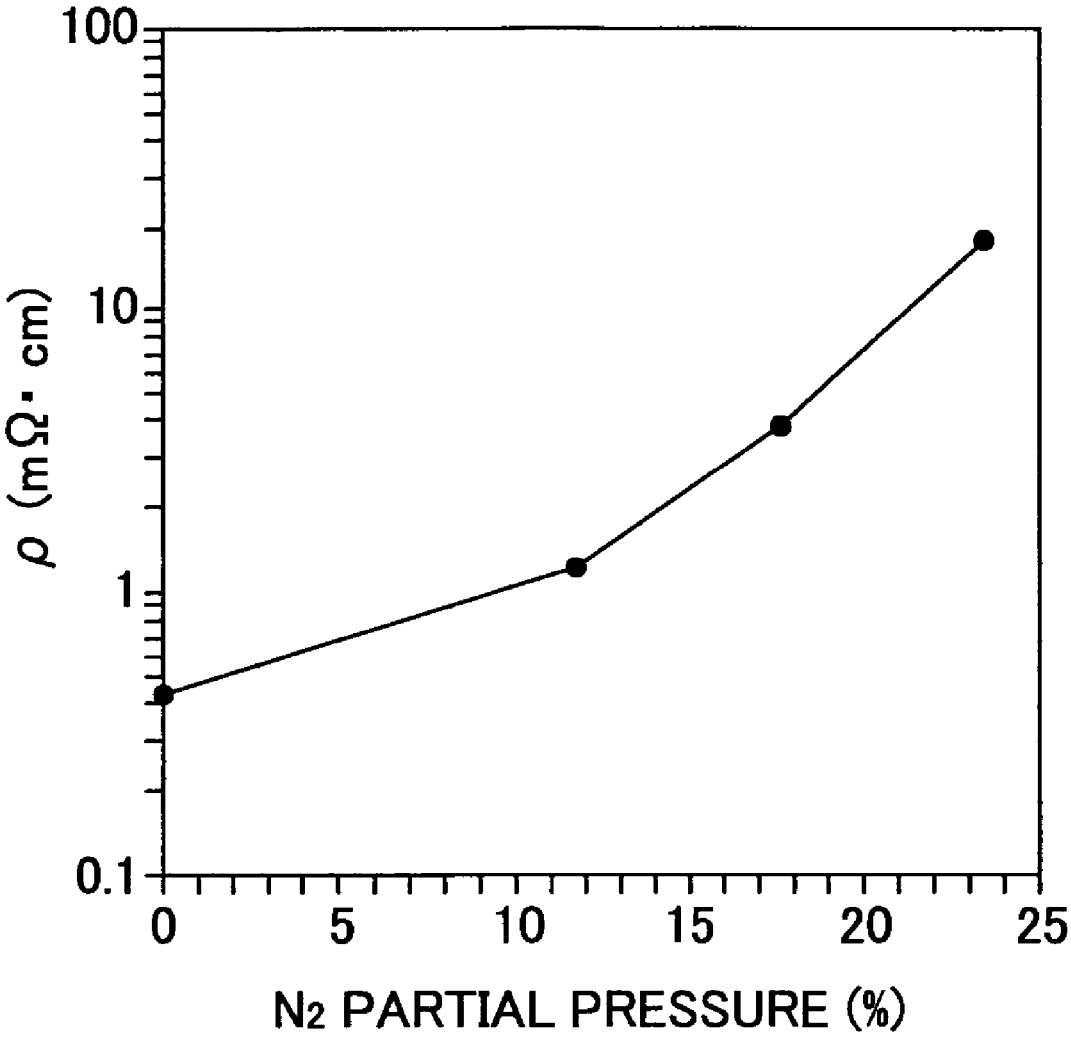
FIG. 10 illustrates the method of manufacturing the modification of the resistor.

FIG. 10 shows the relationship between the $N_2$ partial pressure of the gas for forming a CrSiN film and the resistivity of the CrSiN film. In the graph of FIG. 10, the ordinate axis indicates the resistivity ρ (mΩ·cm (milliohm centimeter)), while the abscissa axis indicates the $N_2$ partial pressure (%). In this experiment shown in the graph, the CrSiN film was formed under the conditions that the Si/Cr ratio of the target was 50/50 wt %, the DC power was 0.7 KW, the amount of $Ar+N_2$ was 85 sccm, the pressure was 8.5 mTorr, and the processing time was 6 seconds, with the $N_2$ partial pressure of the $Ar+N_2$ gas being adjusted.

A CrSiN film that is formed by reactive sputtering, with the $N_2$ partial pressure being added by 18% or more, exhibits resistivity ten or more times as high as the resistivity of a CrSiN film that is formed using a gas without $N_2$ (the $N_2$ partial pressure being 0%). Accordingly, if a CrSiN film is formed directly on the CrSi thin-film resistor, with the $N_2$ partial pressure being set at 18% or higher, the resistance value of the CrSi thin-film resistor is determined by the CrSi thin film, and is not affected by the CrSiN film. Here, the upper limit of the $N_2$ partial pressure is approximately 90%. If the $N_2$ partial pressure is set at 90% or higher, the sputtering rate greatly decreases, resulting in a drop in production efficiency.

In the resistor 160, the CrSiN film 31 is formed on the CrSi thin-film resistor 15. A CVD insulating film such as a silicon nitride film may be formed on the CrSi thin-film resistor 15. However, a general multi-chamber sputtering device is not equipped with a CVD chamber, and it is necessary to purchase new equipment to form a CVD insulating film on the CrSi thin-film resistor 15 continuously in a vacuum. This leads to an increase in the production cost.

In a structure like the resistor 160 in which the CrSiN film 30 is formed on the CrSi thin film 14 for forming the CrSi thin-film resistor 15, there is no need to purchase new equipment, but the CrSiN film 30 to serve as an oxidization-resistant cover film for the CrSi thin-film resistor 15 can be formed using the existing multi-chamber sputtering device in the same vacuum.

Although the refractory metal film 5 is made of TiN film in the resistor 160, the refractory metal film of the wiring pattern 6 is not limited to that, and a refractory metal film made of TiW or WSi may be employed, for example.

Also in the resistor 160, the single-layer wiring pattern 6 is employed as the metal wiring layer. However, it is not limited to that, and a multi-layer metal wiring structure with a multi-layer wiring pattern may be employed in the resistor 160.

Although the wiring pattern 6 has the refractory metal film 5 formed on the upper surface of the metal material pattern 4 in the resistor 160, the wiring pattern of the resistor of this embodiment is not limited to that, and only the metal material pattern 4 may be employed as the wiring pattern without the refractory metal film 5. In such a case, if the metal material pattern 4 is made of an Al-based alloy, a strong native oxide film is formed on the surface of the metal material pattern 4. Therefore, it is preferable to perform an operation of removing the native oxide film from the surface of the metal material pattern 4 on the bottom surfaces of the connecting holes, after the formation of the connecting holes but prior to the formation of the metal thin film for forming the metal thin-film resistor. The native oxide film removing operation may be performed together with the Ar sputter-etching operation to reduce the variation in the resistance value of the CrSi thin-film resistor 15 with time.

Although the wiring pattern 6 to maintain the potential of the CrSi thin-film resistor 15 of the resistor 160 is formed with the metal material pattern 4 and the refractory metal film 5, a polysilicon pattern may be employed, instead of the metal material pattern 4.

5) Method of Manufacturing Another Modification of the Resistor

Figure 11A:
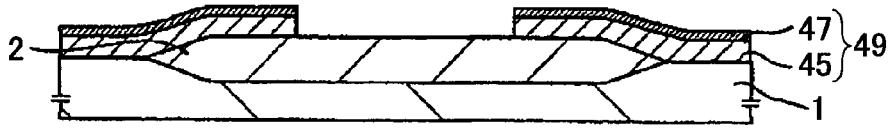
FIGS. 11A through 11D illustrate the method of manufacturing another modification of the resistor of the present invention.
Figure 11B:
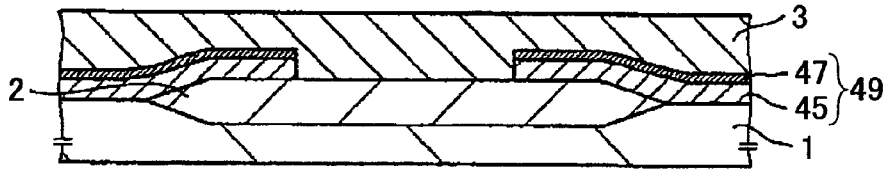
Figure 11C:
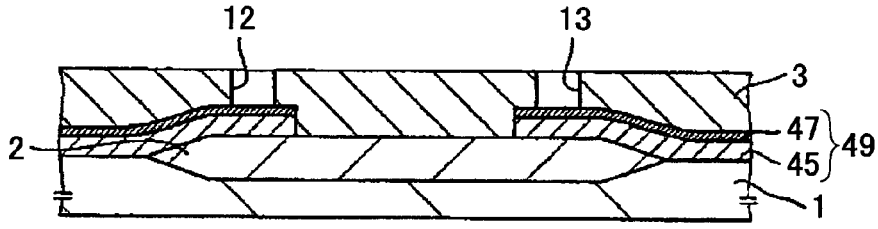
Figure 11D:
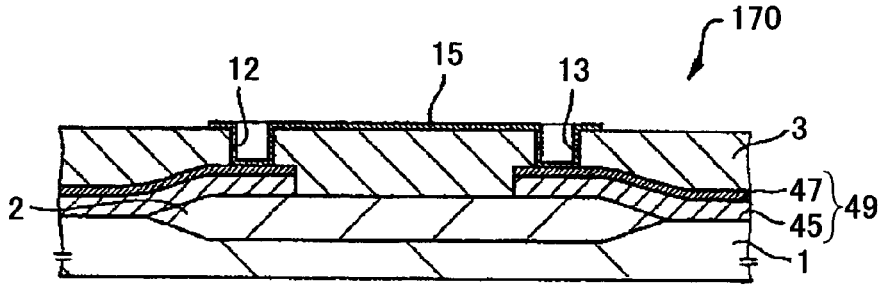

FIGS. 11A through 11D illustrate the method of manufacturing a resistor 170 that is another modification of the resistor 108. FIG. 11D shows the completion drawing of the resistor 170. In the actual resistor 170, a transistor device and a capacitive device are formed on the same substrate, but are not shown in FIGS. 11A through 11D. The same components as those of the resistor 108 illustrated in FIGS. 2A through 3E are denoted by the same reference numerals as those in FIGS. 2A through 3E, and explanation of them is omitted herein.

Referring first to FIG. 11D, the structure of the resistor 170 is described. A device isolating oxide film 2 is formed on a silicon substrate 1. A wiring pattern 49 is formed on an oxide film (not shown) and the device isolating oxide film 2 formed on the silicon substrate 1. The wiring pattern 49 has a polysilicon pattern 45 and a refractory metal film 47 formed in this order. The refractory metal film 47 is made of WSi or TiSi, for example.

A first interlayer insulating film 3 is formed on the silicon substrate 1 including the formation regions of the wiring pattern 49 and the device isolating oxide film 2. In the first interlayer insulating film 3, connecting holes 12 and 13 are formed at the locations corresponding to both end portions of the metal thin-film resistor and the wiring pattern 49.

On the first interlayer insulting film 3, a CrSi thin-film resistor 15 is formed over the region between the connecting holes 12 and 13, the inner walls of the connecting holes 12 and 13, and the wiring pattern 49. Although not shown in FIG. 1D, an interlayer insulating film, a metal wiring, and a passivation film are formed on the first interlayer insulating film 3 including the formation region of the CrSi thin-film resistor 15.

In the following, referring to FIGS. 11A through 11D, the method of manufacturing the resistor 170 is described.

(Step S30)

Referring to FIG. 11A, the device isolating oxide film 2 is formed on the silicon substrate 1, and an oxide film (not shown) such as a transistor gate oxide film is formed on parts of the surface of the silicon substrate 1 on which the device isolating oxide film 2 does not exist. A polysilicon film (a polysilicon pattern) is then formed on the entire surface of the silicon substrate 1. For example, the low-resistance polysilicon pattern 45 is formed at the same time as the formation of the transistor gate electrode. A refractory metal film is then formed on the entire surface of the silicon substrate 1 including the surface of the polysilicon pattern 45. A salicide process is performed on the polysilicon pattern 45 so as to form the refractory metal film 47 made of TiSi or WSi on the polysilicon pattern 45. Thus, the wiring pattern 49 is formed.

(Step S31)

Referring now to FIG. 11B, the same procedure as the procedure of Step S1 illustrated in FIG. 2A is carried out. More specifically, the first interlayer insulating film 3 is formed on the entire surface of the silicon substrate 1 including the surface of the wiring pattern 49.

(Step S32)

Referring now to FIG. 1C, a resist pattern (not shown in FIG. 1C) for forming connecting holes in the first interlayer insulating film 3 at the locations corresponding to both end portions of the metal thin-film resistor and the wiring pattern 49 is formed by a photolithography technique. With the resist pattern serving as a mask, the first interlayer insulating film 3 is selectively removed to form the connecting holes 12 and 13 in the first interlayer insulating film 3. Here, the refractory metal film 47 remains on the bottom surfaces of the connecting holes 12 and 13. The resist pattern is then removed.

(Step S33)

Referring now to FIG. 1D, the same procedures as the procedures of Step S8 and Step S9 illustrated in FIGS. 3B and 3C are carried out. Using a multi-chamber sputtering device, for example, Ar sputter-etching is performed, in a vacuum, on the surface of the second interlayer insulating film 11 including the inner surfaces of the connecting holes 12 and 13. Immediately after the Ar sputter-etching, a metal thin film for forming the metal thin-film resistor is formed in the same vacuum. The metal thin film is then patterned to form the CrSi thin-film resistor 15.

Although not shown in FIG. 1D, an interlayer insulating film, a metal wiring film, and a passivation film are formed on the first interlayer insulating film 3 including the formation region of the CrSi thin-film resistor 15.

In this embodiment, it is not necessary to perform patterning by a wet etching technique after the CrSi thin-film resistor 15 is patterned, as in the case of the resistor 108 illustrated in FIGS. 2A through 3E. Furthermore, since the contact surface between the CrSi thin-film resistor 15 and the wiring pattern 49 is not exposed to the air, excellent ohmic connection can be constantly established between the CrSi thin-film resistor 15 and the wiring pattern 49. Thus, regardless of the film thickness of the CrSi thin-film resistor, the CrSi thin-film resistor 15 can have a more minute structure and a stable resistance value, without an increase in the number of manufacturing procedures.

Also, as the refractory metal film 47 that functions as a barrier film is interposed between the CrSi thin-film resistor 15 and the polysilicon pattern 45, the variation in the contact resistance between the CrSi thin-film resistor 15 and the wiring pattern 49 can be reduced. Thus, the accuracy of resistance values can be increased, and higher yield can be achieved.

Furthermore, the refractory metal film 47 contributes to the low resistance of the polysilicon pattern 45. Since the refractory metal film 47 can be formed without an increase in the number of manufacturing procedures, an increase in the production cost can be prevented, and the contact resistance between the metal thin-film resistor and the wiring pattern can be stabilized.

By the manufacturing method in this embodiment, Ar sputter-etching is performed before the formation of the metal thin film for forming the CrSi thin-film resistor 15. Accordingly, the variation in the resistance value caused by the time elapsed since the previous procedure and the difference between the base films of the products can be reduced.

In the resistor 170 illustrated in FIGS. 11A through 11D, a CrSiN film may be formed on the CrSi thin-film resistor 15, as in the resistor 160 illustrated in FIGS. 9A through 9D.

In the resistors 108, 109, 160, and 170, and the samples manufactured under the conditions shown in FIGS. 4, 5, 6A and 6B, 7, 8, and 10, CrSi is used as the material for each metal thin-film resistor. However, the present invention is not limited to CrSi thin-film resistors, and other materials, such as NiCr, TaN, $CrSi_2$, CrSiN, and CrSiO, may be used as the material for each metal thin-film resistor.

6) Other Embodiments of the Reference Voltage Generating Circuit

Figure 12:
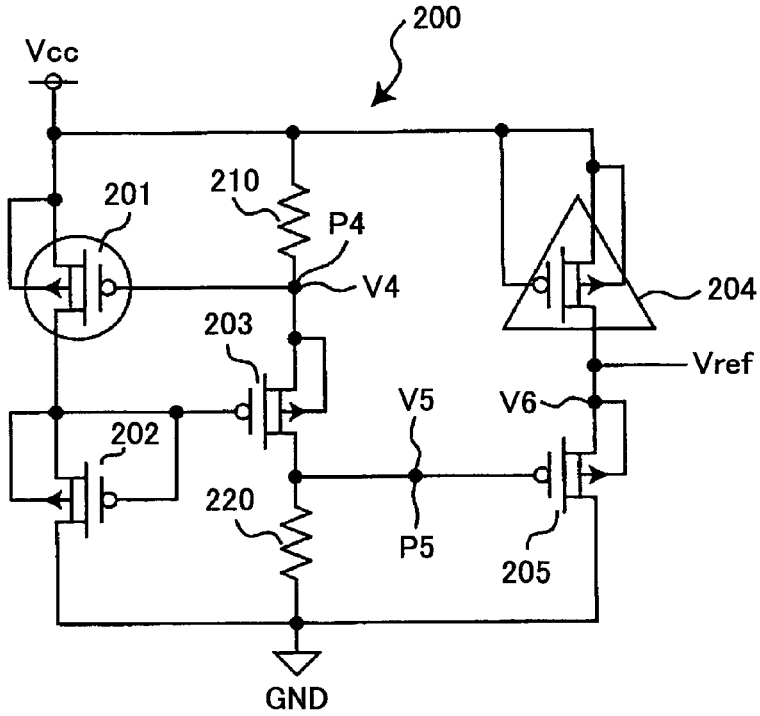
FIG. 12 illustrates a modification of the reference voltage generating circuit of the present invention.
Figure 13:
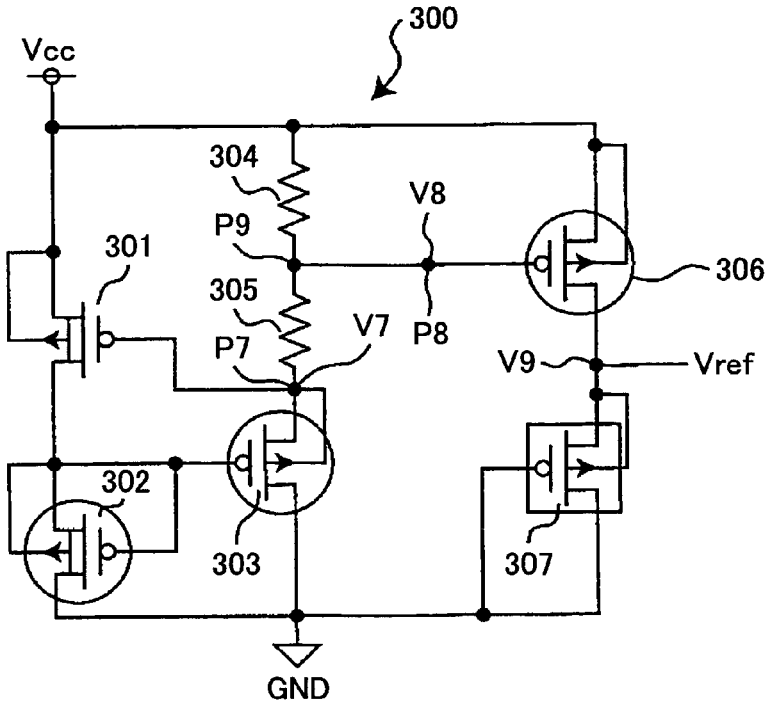
FIG. 13 illustrates another modification of the reference voltage generating circuit of the present invention.
Figure 15B:
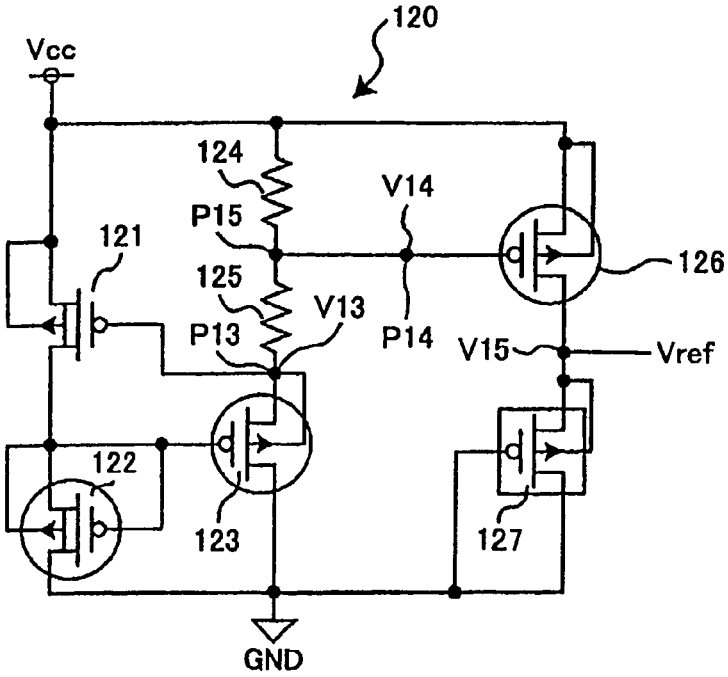
FIG.15B (PRIOR ART)
Figure 16A:
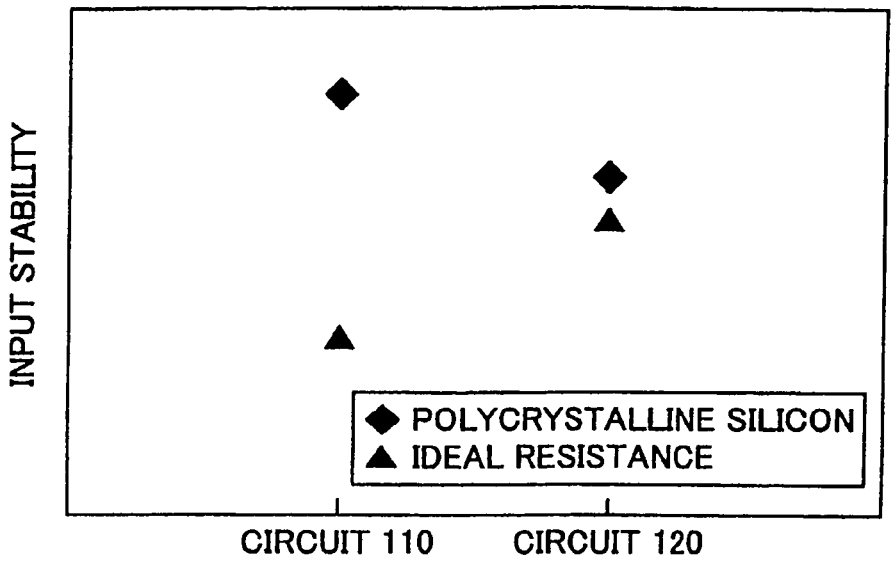
FIG.16A (PRIOR ART)
FIG. 16A shows the input stabilities of the conventional reference voltage generating circuits, accompanied with ideal values.
Figure 16B:
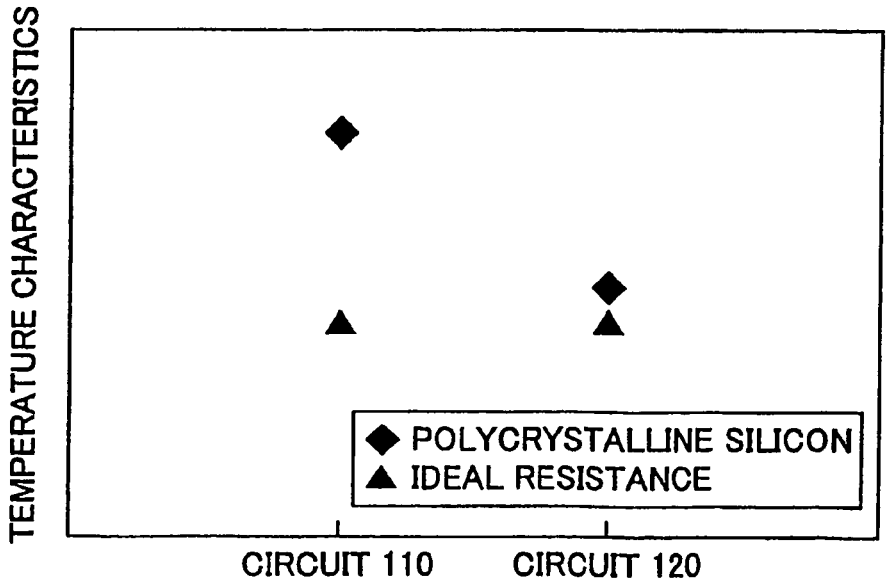
FIG.16B (PRIOR ART)
FIG. 16B shows the characteristics with respect to variations in environmental temperature, accompanied with ideal values.
Figure 17:
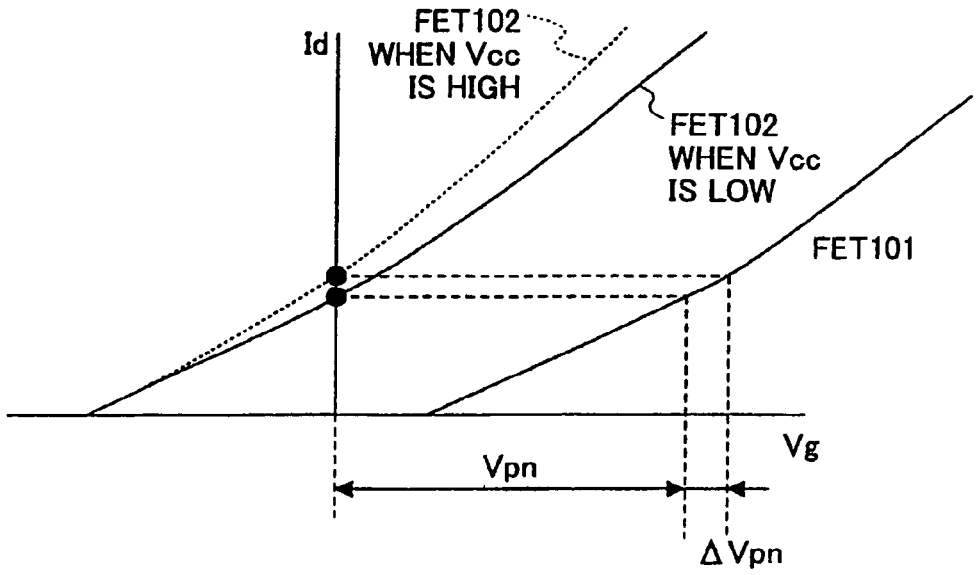
FIG.17 (PRIOR ART)
FIG. 17 shows the Vg-Id characteristics of the FET 101 and the FET 102 of the circuit 110 when the power supply voltage Vcc varied.
Figure 18A:
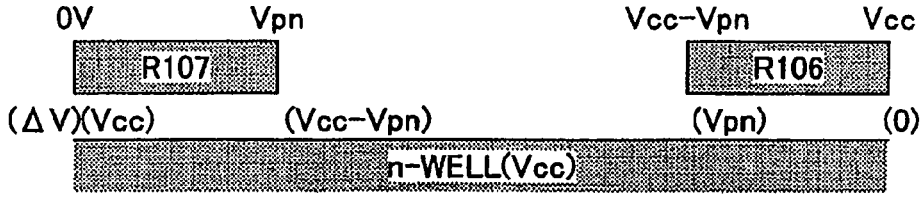
FIG.18A (PRIOR ART)
FIG. 18A shows the potential difference (ΔV) between the resistances 106 and 107 and the n-well of the circuit 110.
Figure 18B:
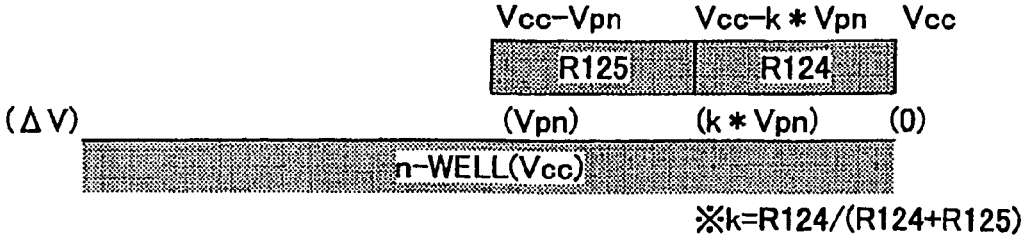
FIG.18B (PRIOR ART)
FIG. 18B shows the potential difference (ΔV) between the resistances 124 and 125 and the n-well of the circuit.

FIG. 12 illustrates the structure of a reference voltage generating circuit 200 in accordance with a second embodiment of the present invention. FIG. 13 illustrates the structure of a reference voltage generating circuit 300 in accordance with a third embodiment of the present invention. The reference voltage generating circuit 300 is the same circuit as the reference voltage generating circuit 120 illustrated in FIG. 15B, except for novel resistors.

The reference voltage generating circuit 200 shown in FIG. 12 includes p-channel field effect transistors (hereinafter referred to simply as FETs) 201 through 205, and resistors 210 and 220. The FETs 201, 202, 204, and 205 have the same substrate-doping and channel-doping impurity concentrations, and are formed in the n-well of a p-type substrate. The substrate potential of each transistor is set at the same value as the source potential.

The FET 201 has a high-concentration p-type gate, and the FET 202 has a high-concentration n-type gate. The FET 201 and the FET 202 are designed to have the same ratio (S=W/L) of the channel width W to the channel length L.

The FET 204 has a low-concentration n-type gate, and the FET 205 has a high-concentration n-type gate. The FETs 204 and 205 are designed to have the same ratio (S=W/L) of the channel width W to the channel length L.

Potential is supplied to the gate of the FET 201 from a source follower circuit that includes a resistance dividing circuit formed with the FET 203 having a high-concentration n-type gate and the two resistors 210 and 220 that are connected in series. The gate of the FET 202 and the gate of the FET 203 are connected to each other. The source and the gate of the FET 203 are connected to each other. The gate of the FET 201 is connected to the connection point between the source of the FET 203 and the resistor 210 (the point P4 representing potential V4 in FIG. 12). The drain of the FET 203 is connected to the gate of the FET 205.

The FET 202 has the source and the gate connected to each other, and functions as a constant current source to supply constant current to the FET 201, to which the FET 202 is series-connected. In this structure, the potential between the source and the gate of the FET 201 that is calculated by subtracting the potential V4 from power supply voltage Vcc is Vpn (=Vcc−V4). Meanwhile, potential V5 is represented as (the resistance value of the resistor 220/the resistance value of the resistor 210)×Vpn.

The FET 204 has the source and the gate connected to each other, and functions as a constant current source to supply constant current to the FET 205, to which the FET 204 is series-connected. With the potential between the source and the gate of the FET 205 being Vnn, the source potential V6 of the FET 205 is represented as V5+Vnn=(the resistance value of the resistor 220/the resistance value of the resistor 210)×Vpn+Vnn (=Vref).

The FET 201 and the FET 202 that are connected in series form a first power supply circuit that exhibits a negative temperature coefficient with respect to a variation in environmental temperature. Meanwhile, the FET 204 and the FET 205 that are connected in series form a second power supply circuit that exhibits a positive temperature coefficient with respect to a variation in environmental temperature. The resistance values of the resistor 210 and the resistor 220, which form the resistance dividing circuit in the source follower circuit, are adjusted by a trimming technique, for example. By doing so, the deviation of the negative temperature coefficient is adjusted, and the positive and negative temperature coefficients are cancelled. In this manner, a circuit that compensates the temperature characteristics and outputs a constant reference voltage Vref in spite of variations in environmental temperature is formed.

The deviations of the temperature coefficients of the respective circuits can be adjusted by changing the impurity concentrations of the high-concentration p-type gate of the FET 201, the high-concentration n-type gates of the FETs 202, 203, and 204, and the low-concentration n-type gate of the FET 205, as well as the resistance values of the resistors 210 and 220.

FIG. 13 illustrates the structure of the reference voltage generating circuit 300. This reference voltage generating circuit 300 includes p-channel FETs 301 through 303, a FET 306, a FET 307, and resistors 304 and 305. The FETs 301 through 303, the FET 306, and the FET 307 have the same substrate-doping and channel-doping impurity concentrations, and are formed in the n-well of a p-type substrate. The substrate potential of each transistor is set at the same value as the source potential.

The FET 301 has a high-concentration n-type gate, and the FET 302 has a high-concentration p-type gate. The FET 301 and the FET 302 are designed to have the same ratio (S=W/L) of the channel width W to the channel length L.

The FET 306 has a high-concentration p-type gate, and the FET 307 has a low-concentration p-type gate. The FETs 306 and 307 are designed to have the same ratio (S=W/L) of the channel width W to the channel length L.

Potential is supplied to the gate of the FET 301 from a source follower circuit that includes a resistance dividing circuit formed with the FET 303 having a high-concentration p-type gate and the two resistors 304 and 305 that are connected in series. The gate of the FET 302 and the gate of the FET 303 are connected to each other. The source and the gate of the FET 303 are connected to each other. The gate of the FET 301 is connected to the connection point between the source of the FET 303 and the resistor 305 (the point P7 representing potential V7 in FIG. 13). The contact point P9 between the resistors 304 and 305 is connected to the gate of the FET 306.

The FET 302 has the source and the gate connected to each other, and functions as a constant current source to supply constant current to the FET 301, to which the FET 302 is series-connected. In this structure, the potential between the source and the gate of the FET 301 that is calculated by subtracting the potential V7 from power supply voltage Vcc is Vpn (=Vcc−V7). Meanwhile, potential V8 is represented as Vcc−[(the resistance value of the resistor 304)×(the resistance value of the resistor 304+the resistance value of the resistor 305)×Vpn].

The FET 306 has the source and the gate connected to each other, and functions as a constant current source to supply constant current to the FET 307, to which the FET 306 is series-connected. With the potential between the source and the gate of the FET 307 being Vnn, the source potential V9 of the FET 307 is represented as Vcc−V9+Vnn=(the resistance value of the resistor 304/(the resistance value of the resistor 304+the resistance value of the resistor 305))×Vpn+Vnn (=Vref).

The FET 301 and the FET 302 that are connected in series form a first power supply circuit that exhibits a negative temperature coefficient with respect to a variation in environmental temperature. Meanwhile, the FET 306 and the FET 307 that are connected in series form a second power supply circuit that exhibits a positive temperature coefficient with respect to a variation in environmental temperature. The resistance values of the resistor 304 and the resistor 305, which form the resistance dividing circuit in the source follower circuit, are adjusted by a trimming technique, for example. By doing so, the deviation of the negative temperature coefficient is adjusted, and a circuit that compensates the temperature characteristics and outputs a constant reference voltage Vref in spite of variations in environmental temperature is formed. The deviations of the temperature coefficients of the respective circuits can be adjusted by changing the impurity concentrations of the high-concentration p-type gate of the FET 302 and the low-concentration n-type gate of the FET 307, as well as the resistance values of the resistors 304 and 305.

Figure 14A:
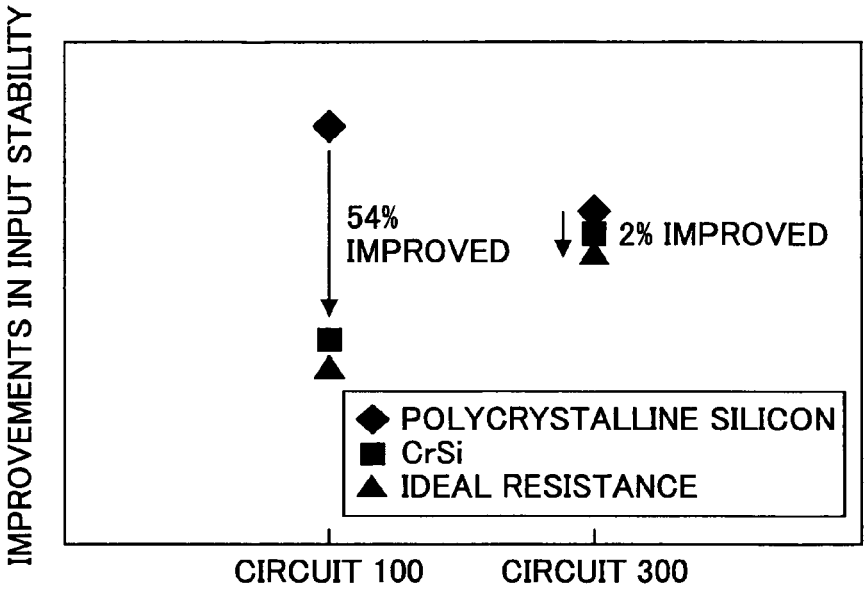
FIG. 14A shows improvements in the input stabilities of the reference voltage generating circuits of the present invention.
Figure 14B:
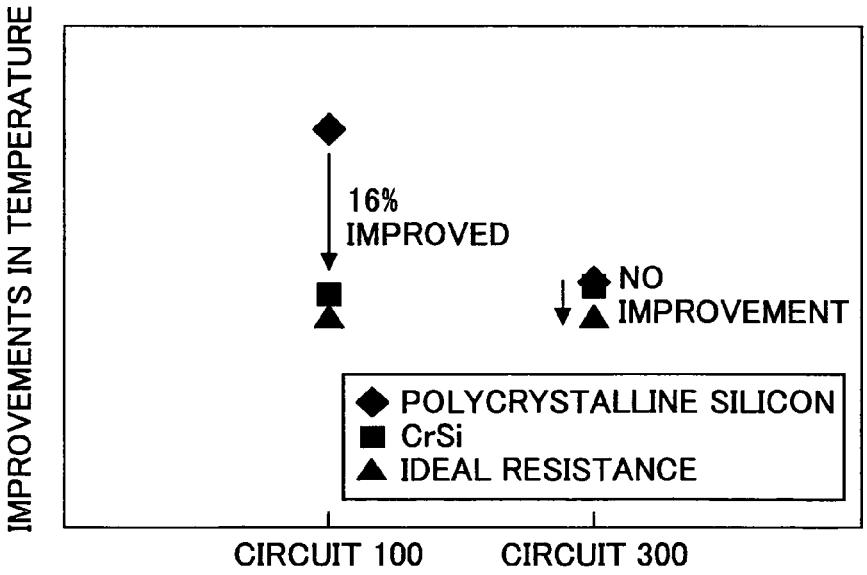
FIG. 14B shows improvements in the characteristics of the reference voltage generating circuits with respect to variations in environmental temperature.

7) Characteristics of Reference Voltage Generating Circuits with Novel Resistors FIGS. 14A and 14B show the input stability and the temperature characteristics of each of the reference voltage generating circuits 100 and 300 illustrated in FIGS. 1 and 13, with respect to variations in environmental temperature. In FIGS. 14A and 14B, ideal values are also shown, as well as the input stability and the temperature characteristics of each of the conventional reference voltage generating circuits 110 and 120. The input stability indicates the stability of the value of the reference voltage Vref to be output with respect to a variation in the value of the power supply voltage Vcc. The more stable the reference voltage Vref is, the closer the value is to the ideal value. As for the temperature characteristics, the value becomes closer to the ideal value as the inclination of the temperature coefficient becomes more flat. In FIGS. 14A and 14B, the input stability and the temperature characteristics of each of the circuits 110 and 120 having polycrystalline silicon resistors are shown by ♦, the input stability and the temperature characteristics of each of the circuits 100 and 300 having the novel CrSi thin-film resistors are shown by ■, and the ideal values are shown by ▲.

As can be seen from FIGS. 14A and 14B, in the case of the reference voltage generating circuit 100 of the first embodiment having the novel resistors 108 and 109, the input stability is 54% higher and the temperature characteristics are 16% better than in the case of the conventional reference voltage generating circuit 110 using the polycrystalline silicon resistors 106 and 107. Thus, the input stability and the temperature characteristics of the reference voltage generating circuit 100 of the first embodiment are much closer to the ideal values.

In the case of the reference voltage generating circuit 300 of the third embodiment using the novel resistors 304 and 305, on the other hand, the input stability and the temperature characteristics are not much higher or better than in the case of the conventional reference voltage generating circuit 120 having the polycrystalline silicon resistors 124 and 125. This is because the input stability and the temperature characteristics of each of the reference voltage generating circuit 300 and the conventional reference voltage generating circuit with the polycrystalline silicon resistors are very close to the ideal values in the first place, as mentioned in the description of the prior art.

As a result of combining the novel metal thin-film resistors and the conventional reference voltage generating circuits, it is apparent that the input stability and the temperature characteristics are improved by employing the novel metal thin-film resistors (108, 109, 304, 305) or the modified resistors 160 and 170, instead of the polycrystalline silicon resistors (106, 107, 124, 125), in the conventional reference voltage generating circuit (110, 120). Especially in the case where the novel resistors 108 and 109 are employed in the conventional reference voltage generating circuit 110 (equivalent to the reference voltage generating circuit 100 of the first embodiment), the input stability and the temperature characteristics are dramatically improved and become closer to the ideal values.

It should be noted that the present invention is not limited to the embodiments specifically disclosed above, but other variations and modifications may be made without departing from the scope of the present invention.

This patent application is based on Japanese Priority Patent Application No. 2004-100007, filed on Mar. 30, 2004, the entire contents of which are hereby incorporated by reference.

What is claimed is:

1. A reference voltage generating circuit comprising:

a resistance dividing circuit comprising a plurality of resistors that are connected in series, the plurality of resistors being formed of a metal thin film, each of the plurality of resistors comprising a wiring pattern, an insulating film and a refractory metal film, wherein the wiring pattern is arranged below the metal thin film, the insulating film is arranged between the metal thin film and the wiring pattern, and comprises connecting holes at locations which correspond to connecting portions of the wiring pattern, each of the connecting holes having a top and a bottom, the metal thin film is ohmically connected to the connecting portions of the wiring pattern via the connecting holes, the refractory metal film is interposed between the metal thin film and the connecting portions of the wiring pattern, and the metal thin film extends through the connecting holes from the tops of the connecting holes to the bottoms of the connecting holes, such that the metal thin film is coupled to the wiring pattern via the connecting holes in the insulating film.

2. The reference voltage generating circuit as claimed in claim 1, comprising:

a first power supply circuit comprising a plurality of field effect transistors having gates of different conductivity types, and outputs a voltage having a negative temperature coefficient with respect to a variation in environmental temperature;

a source follower circuit comprising: a first field effect transistor that is connected to the gate of the first power supply circuit; and the resistance dividing circuit, the resistance dividing circuit being connected in series between the drain and ground of the first field effect transistor and a source of the first field effect transistor and power supply voltage Vcc, and adjusts the deviation in the negative temperature coefficient of the voltage that is output from the first power supply circuit; and a second power supply circuit that is connected to the source follower circuit, the second power supply circuit being formed with a plurality of field effect transistors having the same conductivity type and gates with different impurity concentrations, is configured to generate voltage having a positive temperature coefficient with respect to a variation in environmental temperature, add the outputs of the source follower circuit, and output a voltage having a compensated temperature coefficient deviation.

3. The reference voltage generating circuit as claimed in claim 2, wherein the first power supply circuit further comprises a field effect transistor with a high-concentration n-type gate and a field effect transistor with a high-concentration p-type gate that are connected in series.

4. The reference voltage generating circuit as claimed in claim 2, wherein the second power supply circuit further comprises a field effect transistor with a high-concentration p-type gate and a field effect transistor with a low-concentration p-type gate that are connected in series.

5. The reference voltage generating circuit as claimed in claim 2, wherein the second power supply circuit further comprises a field effect transistor with a high-concentration n-type gate and a field effect transistor with a low-concentration n-type gate that are connected in series.

6. The reference voltage generating circuit as claimed in claim 1, wherein the metal thin film is made of CrSi.

7. The reference voltage generating circuit as claimed in claim 1, wherein a native oxide film is removed from the inner surface of each of the connecting holes that is in contact with the metal thin film, and another native oxide film is removed from the surface of the wiring pattern in contact with the metal thin film at the bottom of each of the connecting holes.

8. The reference voltage generating circuit as claimed in claim 1, wherein the wiring pattern is formed with a metal material pattern and a refractory metal film that is formed on the metal material pattern.

9. The reference voltage generating circuit as claimed in claim 1, wherein the wiring pattern is formed with a polysilicon pattern and a refractory metal film that is formed on the polysilicon pattern.

10. A reference voltage generating circuit comprising a resistance dividing circuit that comprises a plurality of resistors that are connected in series, the plurality of resistors being formed with a metal thin film, wherein the resistance dividing circuit formed with the plurality of resistors that are connected in series between the drain and ground of the first field effect transistor and between the source of the first field effect transistor and power supply voltage Vcc, and adjusts the deviation in the negative temperature coefficient of the voltage that is output from the first power supply circuit;

a first power supply circuit that is formed with a plurality of field effect transistors having gates of different conductivity types, and outputs voltage having a negative temperature coefficient with respect to a variation in environmental temperature;

a source follower circuit that comprises a first field effect transistor that is connected to the gate of the first power supply circuit; and a second power supply circuit that is connected to the source follower circuit, is formed with a plurality of field effect transistors having the same conductivity type and gates with different impurity concentrations, generates voltage having a positive temperature coefficient with respect to a variation in environmental temperature, adds the outputs of the source follower circuit, and outputs voltage having a compensated temperature coefficient deviation, wherein each of the resistors includes a wiring pattern coupled to the metal thin film via a refractory metal film, and wherein an insulating film is arranged between the metal thin film and the wiring pattern, and the insulating film comprises connecting holes at locations which correspond to connecting portions of the wiring pattern, each of the connecting holes having a top and a bottom, and the metal thin film extends through the connecting holes from the tops of the connecting holes to the bottoms of the connecting holes, such that the metal thin film is coupled to the wiring pattern via the connecting holes.

* * * * *